US009140441B2

(12) United States Patent
Goelz et al.

(10) Patent No.: US 9,140,441 B2
(45) Date of Patent: Sep. 22, 2015

(54) LED DOWNLIGHT

(75) Inventors: David P. Goelz, Milwaukee, WI (US); Bernd R. Sieberth, Salem, WI (US); Kurt S. Wilcox, Libertyville, IL (US); Mario A. Castillo, New Braufels, TX (US); Craig D. Raleigh, Burlington, WI (US)

(73) Assignee: Cree, Inc., Durham, NC (US)

( * ) Notice: Subject to any disclaimer, the term of this patent is extended or adjusted under 35 U.S.C. 154(b) by 171 days.

(21) Appl. No.: 13/586,554

(22) Filed: Aug. 15, 2012

(65) Prior Publication Data

US 2014/0049957 A1 Feb. 20, 2014

(51) Int. Cl.

| | |
|---|---|
| ***F21V 15/00*** | (2015.01) |
| ***F21V 29/76*** | (2015.01) |
| *F21V 13/02* | (2006.01) |
| *F21V 21/04* | (2006.01) |
| *F21Y 101/02* | (2006.01) |
| *F21V 29/89* | (2015.01) |

(52) U.S. Cl.

CPC ..... *F21V 29/763* (2015.01); *F21V 13/02* (2013.01); *F21V 21/047* (2013.01); *F21V 29/89* (2015.01); *F21Y 2101/02* (2013.01)

(58) Field of Classification Search

CPC ..... F21V 21/02; F21V 21/04; F21V 29/004; F21V 29/22; F21V 29/2206; F21V 29/2212; F21V 29/246; F21V 13/02; F21V 21/047; F21V 29/20; F21V 29/763; F21S 8/026; F21S 8/02

USPC ..... 362/373, 147, 148, 235, 249.02, 362/311.02, 364–365, 800

See application file for complete search history.

(56) References Cited

U.S. PATENT DOCUMENTS

| | | | | |
|---|---|---|---|---|
| 5,055,983 | A | 10/1991 | Hunold et al. | |
| 5,567,041 | A * | 10/1996 | Slocum | 362/148 |
| 6,226,723 | B1 | 5/2001 | Gustavson et al. | |
| 6,435,691 | B1 | 8/2002 | Macey et al. | |
| 6,502,968 | B1 | 1/2003 | Simon | |
| 6,654,172 | B2 | 11/2003 | Pond et al. | |
| 7,111,961 | B2 | 9/2006 | Trenchard et al. | |
| D532,183 | S | 11/2006 | Nagai et al. | |
| 7,201,489 | B2 | 4/2007 | Shyu | |
| 7,448,772 | B2 | 11/2008 | Hampton | |
| D593,514 | S | 6/2009 | Plonski et al. | |
| D596,590 | S | 7/2009 | Plonski et al. | |
| 7,614,769 | B2 | 11/2009 | Sell | |
| 7,670,021 | B2 | 3/2010 | Chou | |
| 7,677,766 | B2 | 3/2010 | Boyer | |
| 7,682,051 | B2 | 3/2010 | Xiao et al. | |
| 7,704,762 | B2 | 4/2010 | Jeganathan et al. | |
| 7,722,227 | B2 | 5/2010 | Zhang et al. | |
| 7,784,970 | B2 | 8/2010 | Sun | |

(Continued)

*Primary Examiner* — Jason Moon Han

(74) *Attorney, Agent, or Firm* — McCracken & Gillen LLC

(57) ABSTRACT

A lighting device includes a substrate, a light emitting diode (LED) array mounted on a first surface of the substrate, and circuit components mounted on the first surface of the substrate and coupled to the LED array wherein the circuit components are adapted to control electrical power applied to the LED array. A heat exchanger is mounted on a second surface of the substrate and a reflector is disposed about the LED array wherein the reflector has a reflection surface that is convex on a first side of an inflection locus and concave on a second side of the inflection locus, and wherein the first side of the inflection locus is proximate the LED array. A diffuser is adjacent the second side of the inflection locus of the reflector.

42 Claims, 16 Drawing Sheets

(56) References Cited

U.S. PATENT DOCUMENTS

| | | | | |
|---|---|---|---|---|
| 7,872,418 | B2 | 1/2011 | Hata et al. | |
| 7,918,591 | B2 | 4/2011 | Lynch | |
| 7,950,832 | B2 | 5/2011 | Tanaka et al. | |
| 7,959,332 | B2 | 6/2011 | Tickner et al. | |
| 7,972,043 | B2 * | 7/2011 | Schutte | 362/365 |
| D642,998 | S | 8/2011 | Lin et al. | |
| 7,993,034 | B2 | 8/2011 | Wegner | |
| 8,021,017 | B2 | 9/2011 | Cheng | |
| D654,444 | S | 2/2012 | Lin et al. | |
| 8,118,449 | B2 | 2/2012 | Pawelko et al. | |
| 8,136,965 | B2 | 3/2012 | Pickard et al. | |
| 8,142,057 | B2 | 3/2012 | Roos et al. | |
| 8,157,422 | B2 | 4/2012 | Paik et al. | |
| 8,684,569 | B2 * | 4/2014 | Pickard et al. | 362/382 |
| 2008/0278957 | A1 | 11/2008 | Pickard et al. | |
| 2009/0284958 | A1 | 11/2009 | Pickard et al. | |
| 2010/0053956 | A1 | 3/2010 | Park et al. | |
| 2010/0110699 | A1 * | 5/2010 | Chou | 362/365 |
| 2010/0296272 | A1 | 11/2010 | Roos et al. | |
| 2010/0302778 | A1 | 12/2010 | Dabiet et al. | |
| 2011/0075411 | A1 | 3/2011 | Van De Ven et al. | |
| 2011/0075414 | A1 | 3/2011 | Van De Ven et al. | |
| 2011/0075422 | A1 * | 3/2011 | Van De Ven et al. | 362/249.02 |
| 2011/0080727 | A1 | 4/2011 | Maxik et al. | |
| 2011/0134634 | A1 | 6/2011 | Gingrich, III et al. | |
| 2011/0169031 | A1 | 7/2011 | Pickard et al. | |
| 2011/0182065 | A1 | 7/2011 | Negley et al. | |
| 2011/0198984 | A1 | 8/2011 | Van de Ven | |
| 2011/0242812 | A1 | 10/2011 | Wang | |
| 2011/0291588 | A1 | 12/2011 | Tagare | |
| 2011/0298371 | A1 | 12/2011 | Brandes et al. | |
| 2012/0061704 | A1 | 3/2012 | Jeong et al. | |
| 2012/0069545 | A1 | 3/2012 | Choi et al. | |
| 2012/0081894 | A1 | 4/2012 | Simon et al. | |
| 2012/0081903 | A1 | 4/2012 | Leung et al. | |
| 2012/0081904 | A1 | 4/2012 | Horng | |
| 2012/0087137 | A1 | 4/2012 | Lay et al. | |
| 2012/0120658 | A1 * | 5/2012 | Wilk | 362/249.02 |
| 2013/0010464 | A1 * | 1/2013 | Shuja et al. | 362/235 |
| 2013/0258677 | A1 * | 10/2013 | Fryzek et al. | 362/326 |

* cited by examiner

LED DOWNLIGHT

CROSS REFERENCE TO RELATED APPLICATIONS

Not applicable

REFERENCE REGARDING FEDERALLY SPONSORED RESEARCH OR DEVELOPMENT

Not applicable

SEQUENTIAL LISTING

Not applicable

BACKGROUND OF THE INVENTION

1. Field of the Invention

The present inventive subject matter relates to solid state lighting devices.

2. Background of the Invention

Solid state light emitters including organic, inorganic, and polymer light emitting diodes (LEDs) may be utilized as an energy-efficient alternative to more traditional lighting systems. About ninety percent of the electricity consumed by an incandescent bulb is released as heat rather than light. In contrast to a typical 60-watt incandescent bulb that has an efficacy of about 13.3 to 14.2 lumens per watt, an LED light source can provide up to 200 lumens per watt.

Many modern lighting applications utilize high power solid state emitters to provide a desired level of brightness. High power solid state emitters generate heat that must be dissipated to prolong the life of the emitters. Generally, the lifetime of an LED is inversely related to the operating junction temperature thereof. Therefore, thermal management of the junction temperature is an important design consideration of a lighting device (or fixture) incorporating one or more LED's. For example, limiting the junction temperature of a particular LED manufactured by the assignee of the present application below 85° C. can result in an LED lifetime of approximately 50,000 hours. Operation of a such a solid state light source at a junction temperature of higher temperatures of 95° C., 105° C., 115° C., and 125° C. may result in life durations of 25,000 hours, 12,000 hours, 6,000 hours, and 3,000 hours, respectively. Many solid state lighting systems utilize a heat exchanger that dissipates heat into the ambient environment. Heat exchangers may be sized and shaped to maintain a specific solid state emitter junction temperature so as to obtain a desired life of the solid state emitters.

LEDs operate more efficiently when powered by a direct current (DC) voltage rather than an alternating current (AC) voltage. Solid state light emitting devices may typically be operated by control circuitry including an AC to DC converter because power is supplied to the device as AC voltage. The conversion circuitry (which may utilize a bulky transformer and one or more solid state electrical elements, such as diodes and one or more transistors) may be incorporated within the device thereby increasing fixture costs and space requirements. A more ready acceptance of LED lighting fixtures could be realized if size and costs could be reduced.

Heat exchangers are made of thermally conductive materials such as aluminum or an aluminum alloy. The heat flux that a heat exchanger can conduct depends on a variety of factors, such as the type and density of material, the surface area, the heat exchanger geometry, the thicknesses of the various surfaces, the convection coefficient of the ambient air flow, etc.

Further, a lighting device typically includes a reflector and a diffuser to direct light emitted from the solid state emitters. The reflector is made of a reflective material, such as aluminum or silvered plastic. The shape of the reflector in combination with the diffuser and LED array size, array configuration, and relative location of the array to other optical components produces a specific beam spread. The beam spread is the volume of space defined by the generally frustoconical locus of points at which the intensity of the light is equal to 50% of the maximum lumen output. The beam spread determines the coverage of a single lighting unit as well as the spacing and quantity required when a plurality of such units are used for uniform illumination of a surface.

SUMMARY OF THE INVENTION

According to one aspect of the present invention, a lighting device comprises a light emitting diode (LED), a heat exchanger in which the LED is disposed in heat transfer relationship, a reflector having a proximal end disposed about the LED, and a diffuser disposed on a distal end of the reflector. The lighting device has a weight to lumen ratio of no greater than about 2.5 g. per lumen (0.09 oz. per lumen).

According to another aspect of the present invention, a lighting device comprises a substrate including a first surface on which is disposed an LED, a heat exchanger mounted directly to a second surface of the substrate opposite the first surface, a reflector having a proximal end disposed about the LED array, and a diffuser disposed on a distal end of the reflector. A profile to lumen ratio of the device is no greater than about 1.2 $cm^2$ per lumen (0.2 $in^2$ per lumen).

According to a further aspect of the present invention, a lighting device comprises a substrate, an LED array mounted on a first surface of the substrate, circuit components mounted on the first surface of the substrate and coupled to the LED array, a heat exchanger mounted on a second surface of the substrate, a reflector disposed about the LED array, and a diffuser. The circuit components are adapted to control electrical power applied to the LED array. The reflector has a reflection surface that is convex on a first side of an inflection locus and concave on a second side of the inflection locus, and the first side of the inflection locus is proximate the LED array. The diffuser is adjacent to the second side of the inflection locus of the reflector.

According to yet another aspect of the present invention, a lighting device comprises a substrate having a surface, an LED array mounted on the surface of the substrate, and circuit components mounted on the surface of the substrate, coupled to the LED array, and adapted to receive power from a power source. The lighting device has a weight to lumen ratio of no greater than about 2.5 g. per lumen (0.09 oz. per lumen).

Other aspects and advantages of the present invention will become apparent upon consideration of the following detailed description and the attached drawings.

DETAILED DESCRIPTION OF THE PREFERRED EMBODIMENTS

Figure 1:
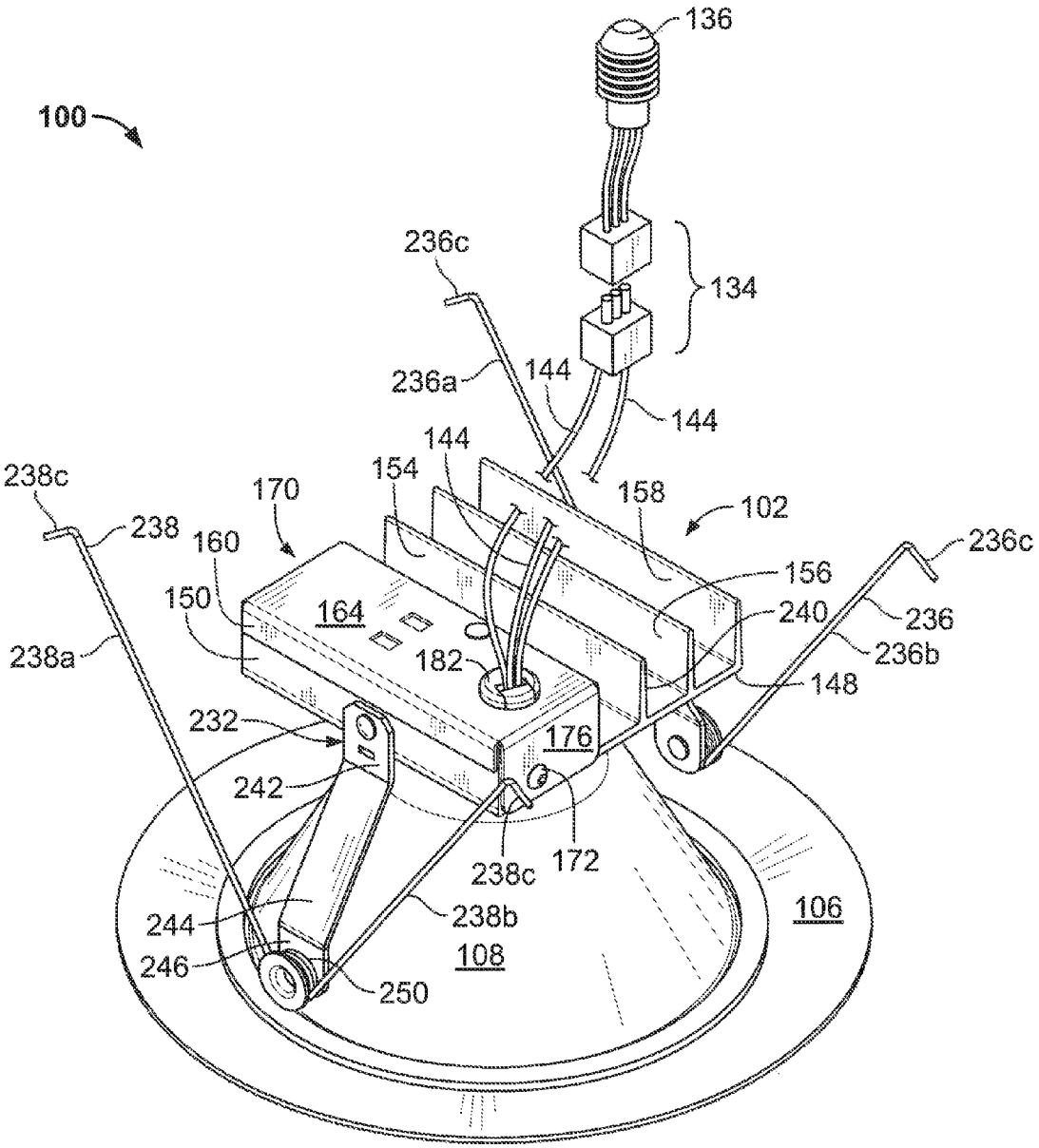
FIG. 1 is an isometric view of a first embodiment of a lighting device from above.
Figure 2:
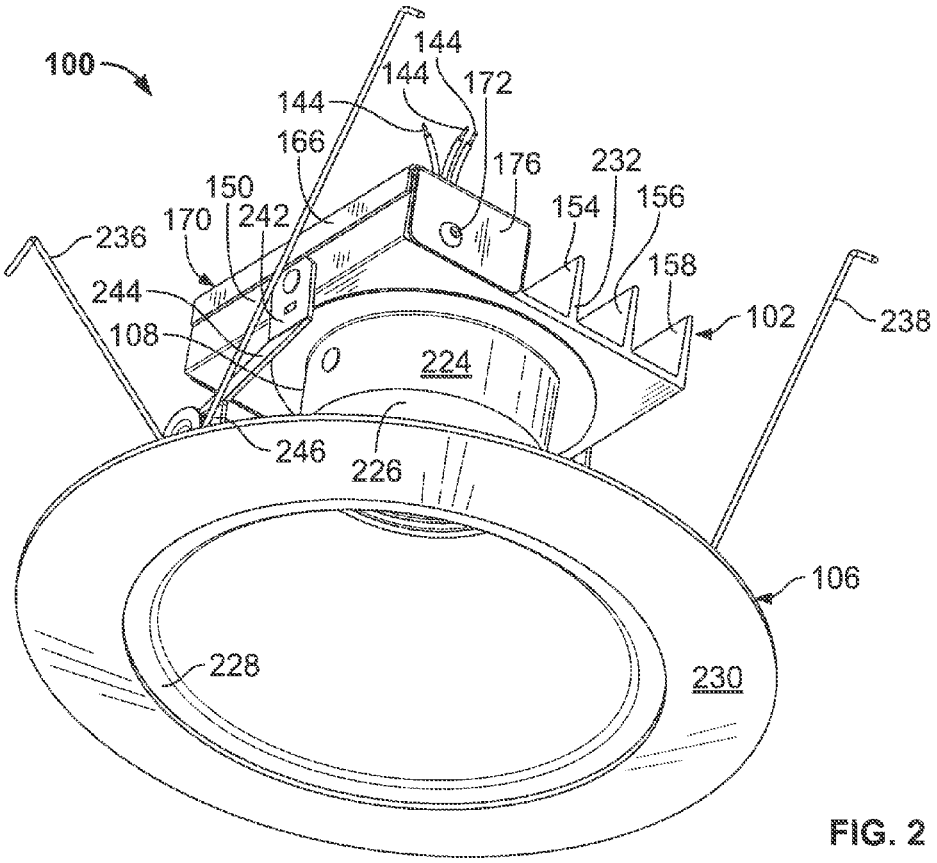
FIG. 2 is an isometric view of the first embodiment of the lighting device from below.
Figure 3:
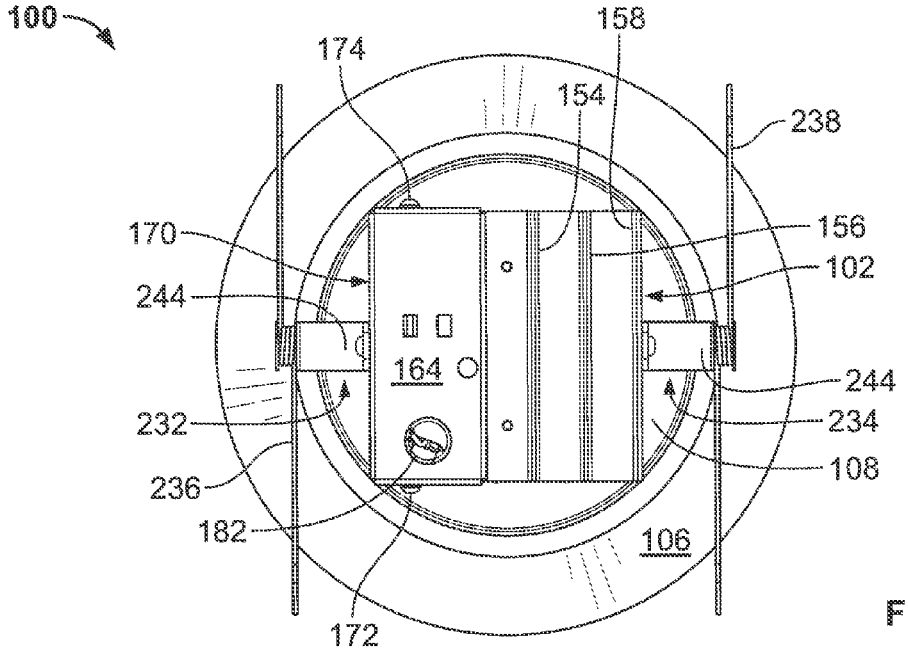
FIG. 3 is a plan view of the first embodiment of the lighting device.
Figure 4:
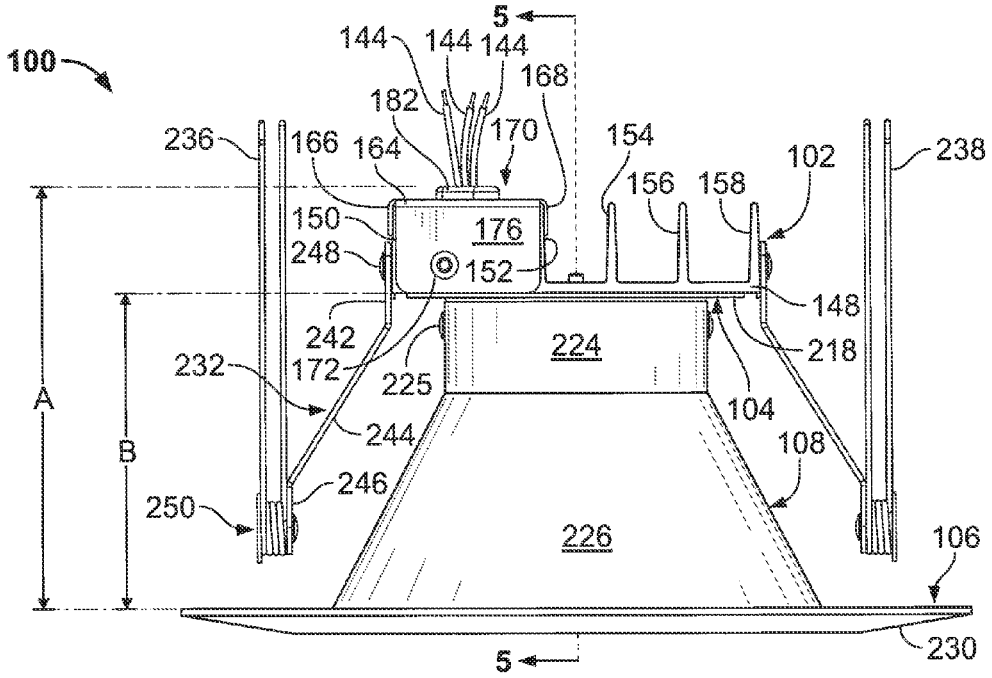
FIG. 4 is a side elevational view of the first embodiment of the lighting device.

FIGS. 1-11, 21-23, and 26 illustrate a first embodiment of a luminaire in the form of a lighting device 100 of the present invention. The lighting device 100 comprises a light engine 101 attached to a heat exchanger 102 by a mounting collar 104. The light engine 101 includes a substrate 110 having an LED array 112, a driver circuit 114, and a centering ring 116 mounted thereon, a reflector 118, and a diffuser 120. The lighting device 100 further comprises a trim ring 106, a housing 108, and means for mounting the lighting device 100 in a can or other existing housing that is, in turn, mounted in a ceiling or other surface.

Figure 6:
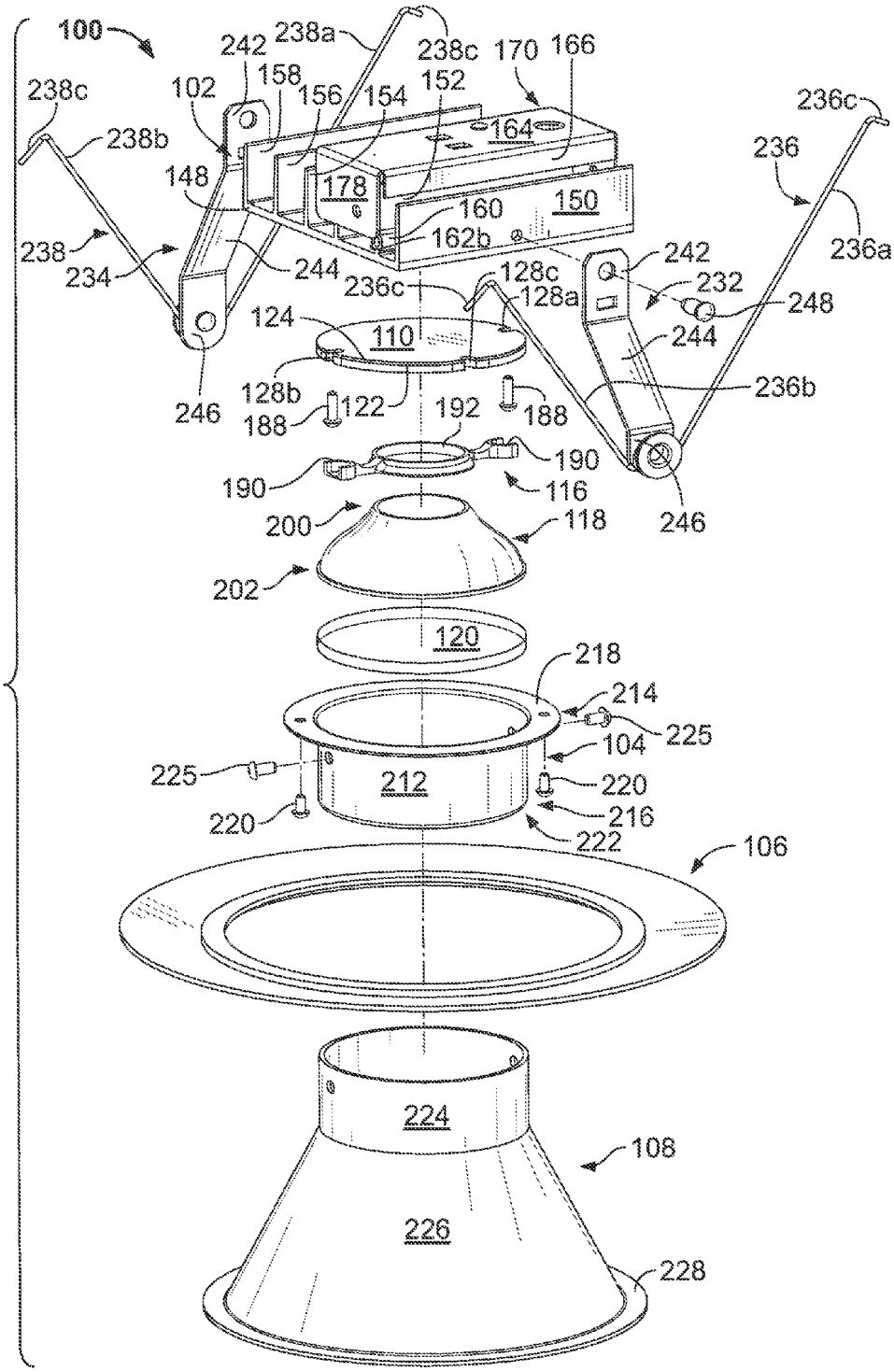
FIG. 6 is an exploded isometric view of the first embodiment of the lighting device from above.
Figure 7:
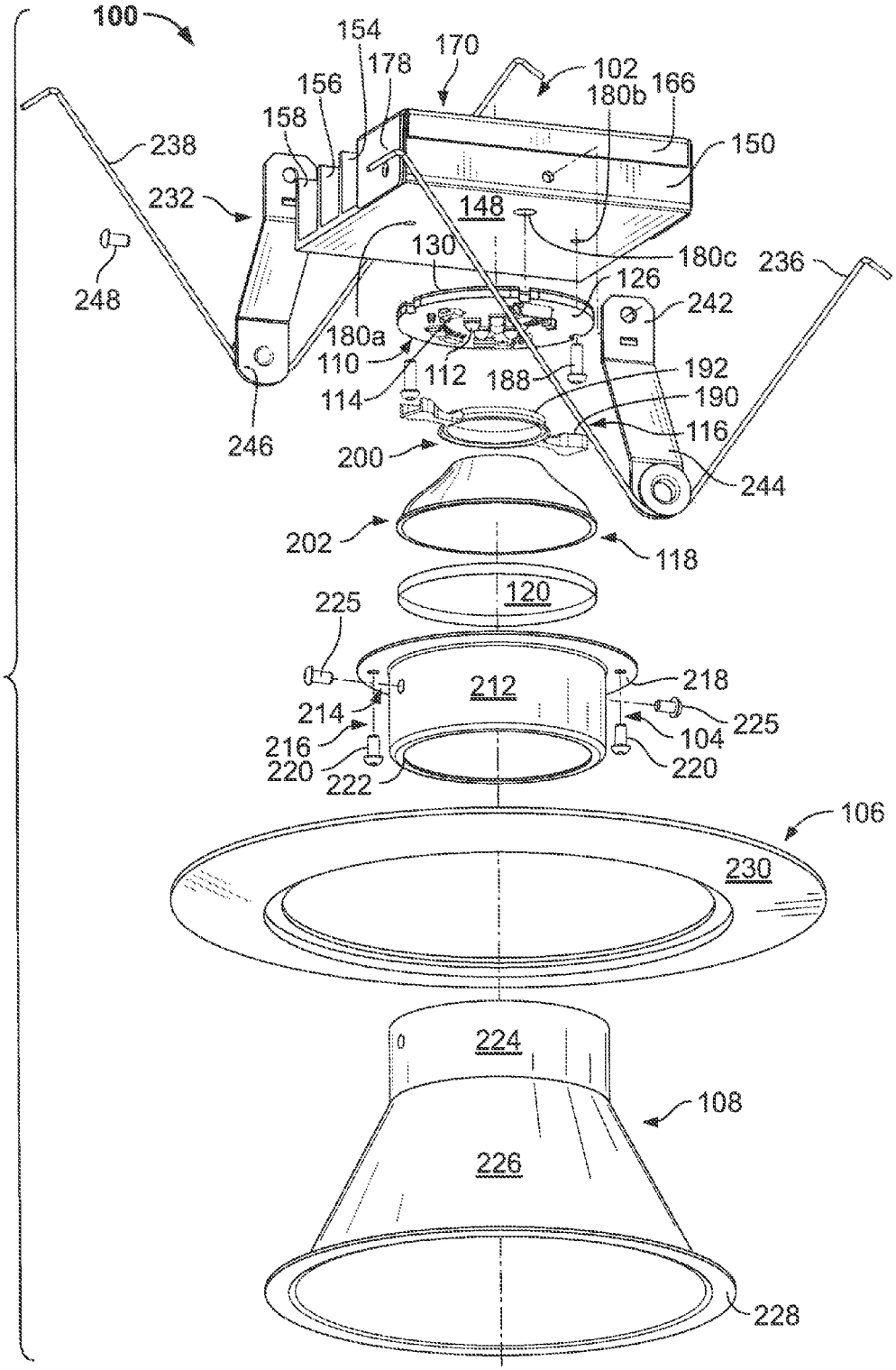
FIG. 7 is an exploded isometric view of the first embodiment of the lighting device from below.
Figure 8:
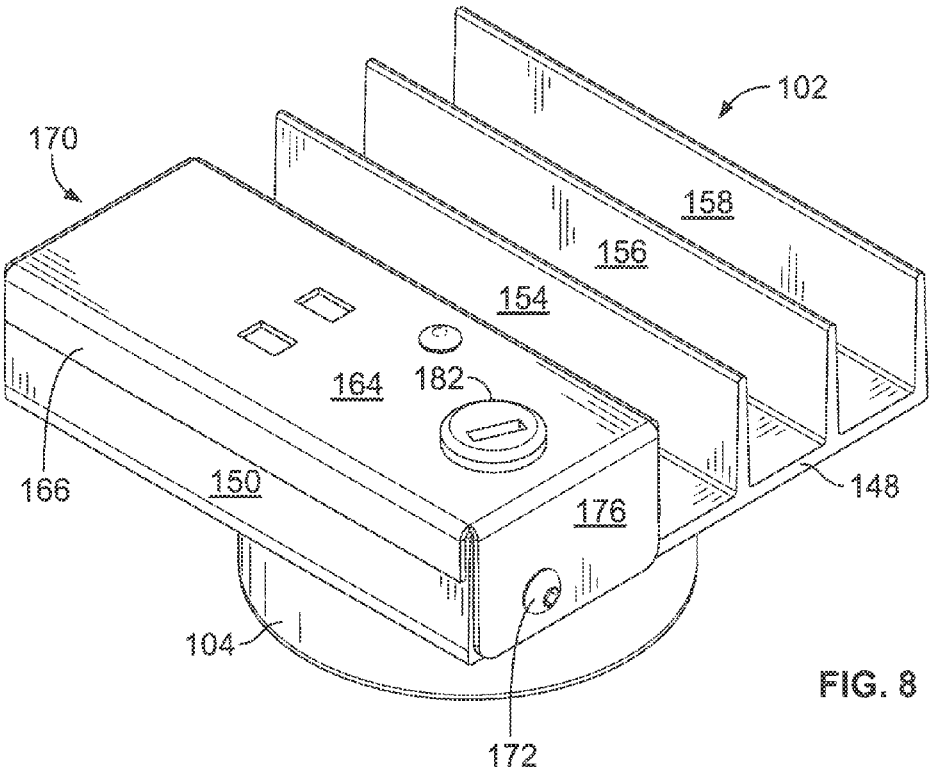
FIG. 8 is an isometric view of the a exchanger, a mounting collar, and associated components.
Figure 9:
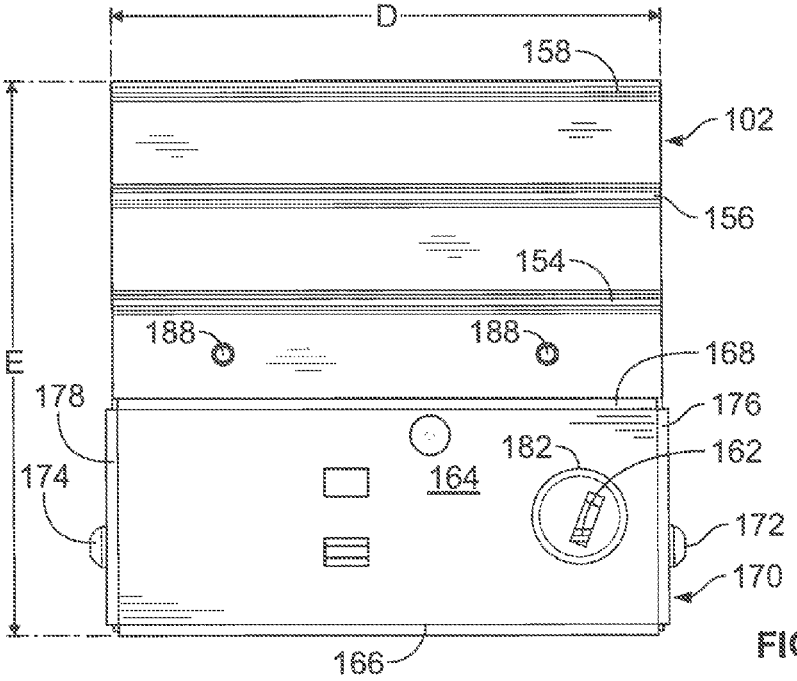
FIG. 9 is a plan view of the heat exchanger, the mounting collar, and associated components.
Figure 10:
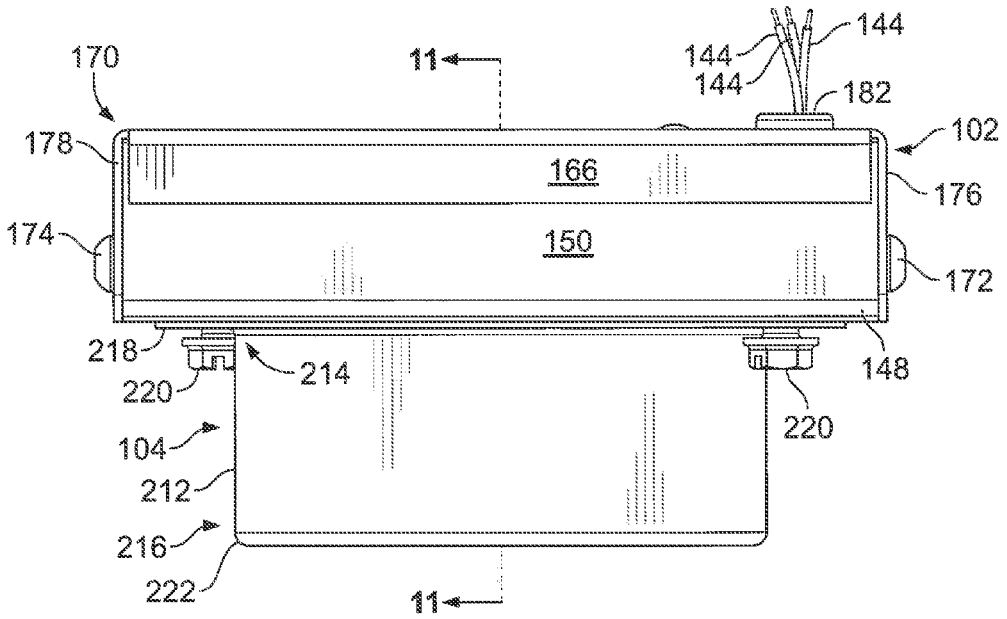
FIG. 10 is an elevational view of the heat exchanger, the mounting collar 116, and associated components.
Figure 11:
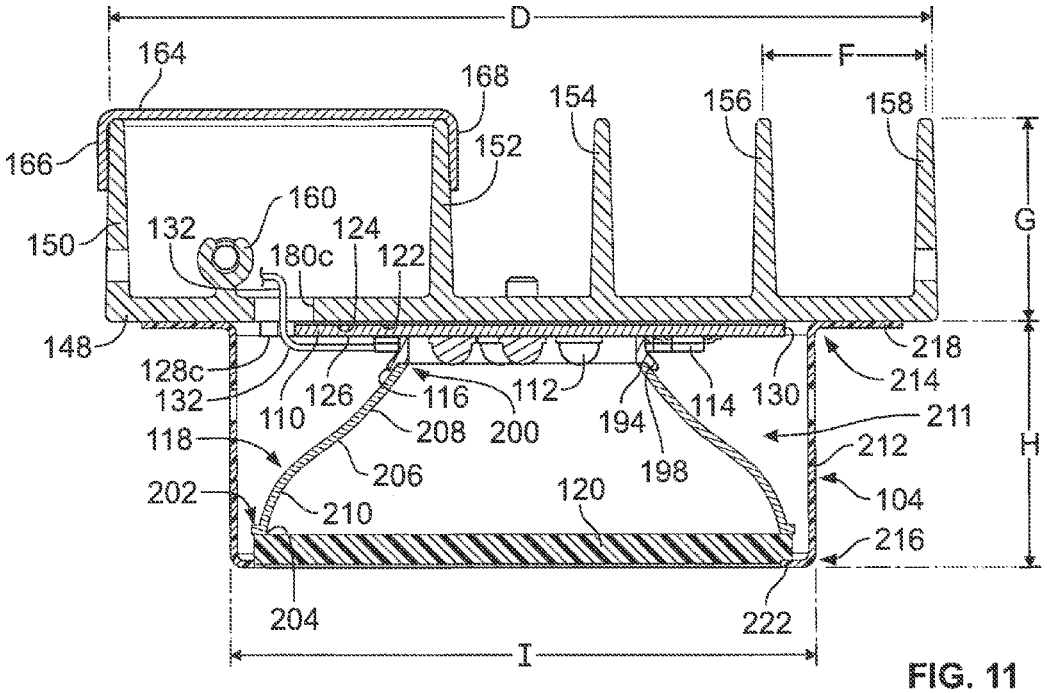
FIG. 11 is a cross sectional view taken generally along the lines 11-11 of FIG. 10.

Referring specifically to FIGS. 6, 7, and 11, the substrate 110 has a first side 122 to which an electrically insulative (or dielectric) and thermally conductive coating or cover layer 124 is applied. The electrical isolation and thermal conductivity characteristics of the coating or cover layer 124 depend in part on the thickness of the layer, which can range from 10 to 100 μm. The heat exchanger 102 abuts the coating or cover layer 124 and is thus in thermal communication with the first side 122 of the substrate 110. The substrate 110 is held against the heat exchanger 102 by the mounting collar 104 when used in combination with the centering ring 116, the reflector 118, and the diffuser 120 as noted in greater detail below.

The LED array 112 and driver circuit 114 are disposed on a second side 126 of the substrate 110. The lighting device 100 of the present invention utilizes blue-white LED dies with yellow phosphor coated on the die encapsulants. The LED array 112 includes a number, for example, three LED strings, and each LED string has one or more individual LED's. The driver circuit 114 directly receives AC power from a household or commercial power source and converts AC power at 110 volts, 60 Hz. into AC power suitable to drive the LED array 112. In the preferred embodiment, the driver circuit 114 provides line voltage to power the LED array 112. In this arrangement, the LED array 112 is divided into segments, and as the line voltage rises, the LED segments turn on in series. As the line voltage falls, the LED segments are turned off. The conversion into suitable AC power by the driver circuit requires fewer electrical components and space than the typical conversion of AC voltage to DC voltage, thereby reducing the cost of the circuit components and allowing the driver circuit 114 to be mounted directly onto the substrate and to fit into a much smaller space than a driver circuit that includes an AC to DC converter. One example of a driver circuit 114 suitable for the present invention is disclosed in U.S. Patent Application Publication No. 2013/0026923, filed Jan. 27, 2012, entitled "Solid State Lighting Apparatus and Methods of Forming", the disclosure of which is hereby incorporated by reference herein. The driver circuit of such patent application is disclosed as being mounted on a rectangular substrate, whereas the driver circuit of the preferred embodiment of the present invention is mounted on a circular substrate as shown in U.S. Design Pat. No. D708,155, filed Apr. 20, 2012, entitled "Solid State Lighting Apparatus" (assignee reference P1557US1), the disclosure of which is also hereby incorporated by reference herein. Applicants further incorporate by reference herein the disclosures of U.S. Provisional Application Ser. No. 61/581,923, filed Dec. 30, 2011, U.S Pat. No. 8,742,671, entitled "Solid State Lighting Apparatus and Methods Using Integrated Driver Circuitry", filed Jul. 28, 2011, U.S. Patent Application Publication No. 2013/0069535, entitled "Solid-State Lighting Apparatus and Methods Using Energy Storage", filed Sep. 16, 2011, and U.S. Patent Application Publication No. 2013/0069536, entitled "Solid-State Lighting Apparatus and Methods Using Current Diversion Controlled by Lighting Device Bias States", filed Sep. 16, 2011. In some embodiments, the driver circuit 114 or power supply for the LED array 112 is directly on the second side 126 of the substrate 110. In other embodiments, the power supply directly connects to the substrate 110.

The number of LEDs (otherwise referred to as dies) may vary between strings. In the preferred embodiment, the LED array 112 comprises three strings of two LEDs each connected together in series and therefore the LED array 112 of the preferred embodiment has six LEDs. Varying the number of LEDs and the power level supplied thereto varies the lumen output. For example, a low-power lighting device 100 that utilizes high voltage LEDs may require about 14 watts to produce about 770 lumens. A medium-power lighting device that utilizes high voltage LEDs may require about 21 watts to produce about 1,360 lumens. Still further, a high-power lighting device that utilizes high voltage LEDs may require about 27 watts to produce about 1,800 lumens. According to the present invention, each of the low-, medium-, and high-power lighting devices 100 has a minimum efficacy of about 50 lumens per watt. Therefore only approximately 9.0%, 22.7%, and 25.0% of the electricity consumed by the low-, medium-, and high-power lighting devices 100, respectively, is released as heat rather than light. Examples of suitable LEDs include, but are not limited to, XLamp XM-L LEDs (high voltage LEDs) or XLamp XT-E White LEDs (high voltage LEDs) manufactured and sold by Cree, Inc. of Durham, N.C. As the substrate 110 is in thermal connection with the heat exchanger 102, heat generated by the LED array 112 is directed into the substrate 110 and then dissipated into the ambient air by the heat exchanger 102.

Referring to FIGS. 6 and 7, the substrate 110 is circular, as noted above, and has three notches 128*a*, 128*b*, 128*c* positioned at 90 degree intervals along an outer edge 130. The LED array 112 disposed on the second side 126 of the substrate 110 is encircled by the centering ring 116. The driver circuit 114 is disposed between the centering ring 116 and the outer edge 130 of the substrate 110. As shown in FIG. 11, wires 132 extend from a connector mounted on the second side 126 through the notch 128*c* of the substrate 110 to a splice box 170 forming a part of the heat exchanger 102 as described in greater detail below.

Referring to FIGS. 8-11, the heat exchanger 102 has a planar, rectangular or square base plate 148 and a plurality of longitudinal fins 150, 152, 154, 156, 158 extending away from the base plate 148. A hollow, longitudinally-split tube 160 having ends 162*a*, 162*b* is disposed in the space between the fins 150, 152 on the base plate 148. A substantially U-shaped cover 164 is disposed over the space between the fins 150, 152 such that side flanges 166, 168 are disposed along facing side surfaces of the fins 150, 152 to form the splice box 170. Fasteners in the form of screws 172, 174 extend through holes in end flanges 176, 178 of the cover 164 into the ends 162*a*, 162*b* to secure the cover 164 on the heat exchanger 102. The heat exchanger is made of any suitable metallic or non-metallic material, such as extruded aluminum.

In each of the embodiments disclosed herein, the heat exchanger (i.e., the base plate, fins, longitudinally-split tube, and splice box cover and associated screws alone) preferably has a weight of approximately 113 (4 oz.), preferably no greater than about 198 g. (7 oz.), preferably between about 85 g. (3 oz.) and about 170 g. (6 oz.), and more preferably between about 99 g. (3.5 oz.) and about 142 g. (5 oz.).

Wires 144 enter the splice box 170 through a grommet 182 as shown in FIG. 1 and are spliced with the wires 132 to connect to the connector on the driver circuit 114 of the substrate 110. The wires 144 are connected to a harness 134 (diagrammatically shown in FIG. 1) and an Edison-type plug 136. The wires 144 include two power leads from the lighting device 100 to the harness 134 and a ground wire that is secured to the interior of a recessed can light housing. The Edison-type plug 136 may be screwed into an Edison-type socket to provide an alternating current through wires 132, 144 to the driver circuit 114.

Two fasteners 188 in the form of screws extend through notches 128*a*, 128*b* in the substrate 110 and through holes 180*a*, 180*b* between the fins 152, 154 on the base plate 148. Two diametrically opposed anchor arms 190 of the centering ring 116 extend outwardly from a central ring portion 192 and are engaged by the two fasteners 188 that extend through the notches 128*a*, 128*b* of the substrate 110 to position the centering ring 116.

Figure 5:
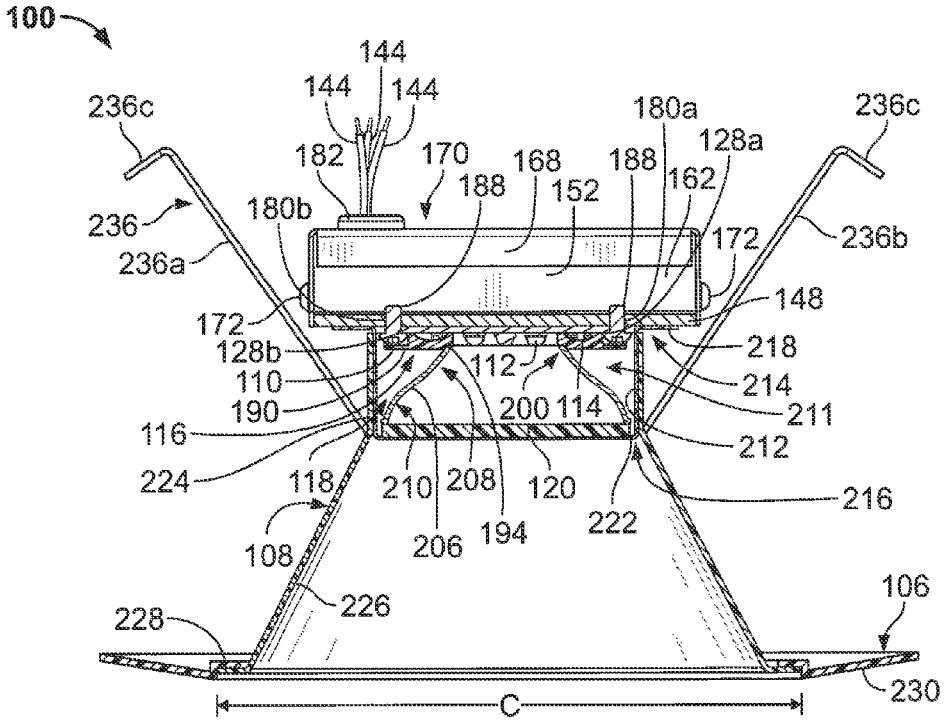
FIG. 5 is a cross sectional view taken generally along the lines 5-5 of FIG. 4.

As seen in FIGS. 5 and 11, the central ring portion 192 includes an annular lip 194 that surrounds the LED array 112. The annular lip 194 defines a recess that receives a proximal end 200 of the reflector 118. The interior surface 198 of the annular lip 194 complements the curvature of the proximal end 200 of the reflector 118 in order to hold the reflector 118 in place relative to the LED array 112 and to provide electrical isolation between the substrate 110 and the reflector 118 when a metallic reflector is used.

Figure 21:
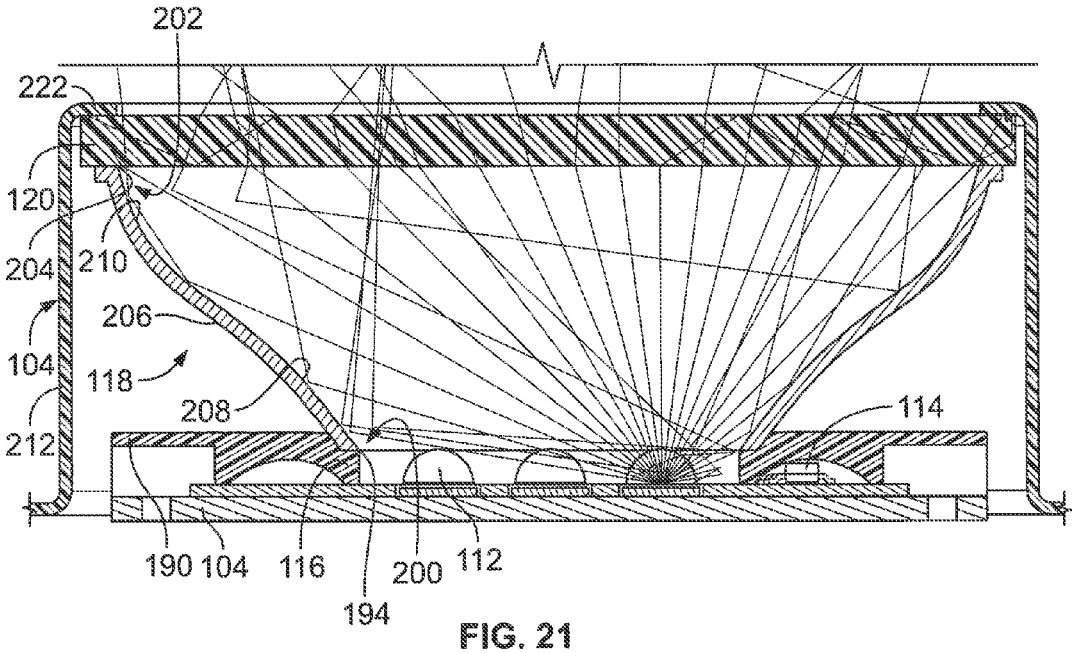
FIG. 21 is a light ray diagram of an outer LED.
Figure 22:
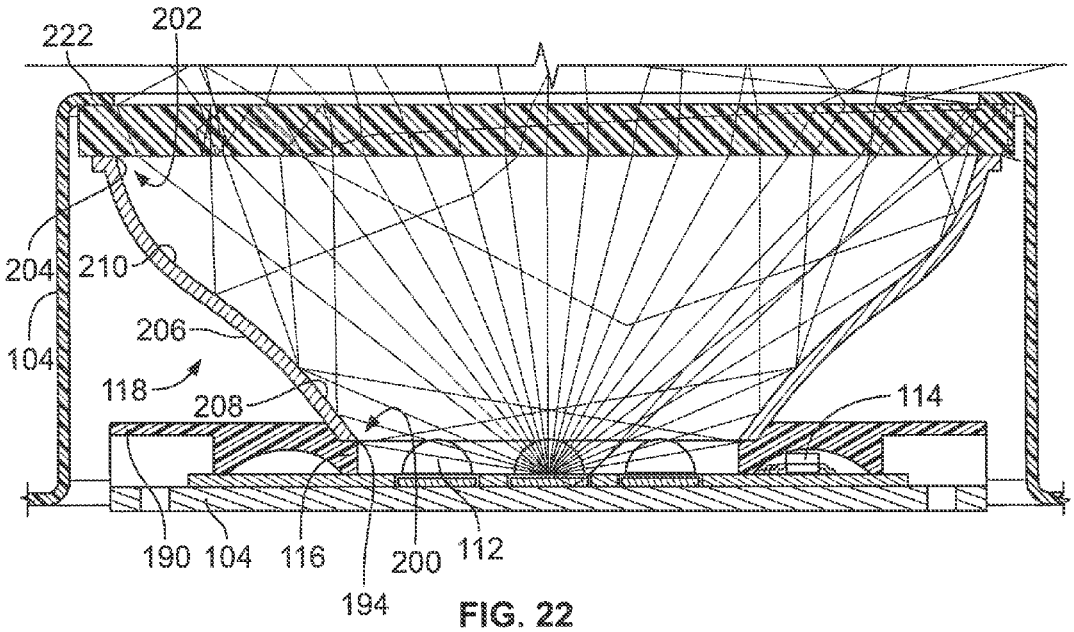
FIG. 22 is a light ray diagram of an inner LED.

The reflector 118 has a distal end 202 opposite the proximal end 200 that includes an aperture 204 as seen in FIGS. 11, 21, and 22. The aperture 204 is covered by the diffuser 120, which is adjacent to and abuts an outwardly directed flange of the reflector 118. An inflection point 206 in the reflector 118 between the proximal and distal ends 200, 202 separates a convex inner reflective surface 208 and a concave inner reflective surface 210, respectively.

Figure 23:
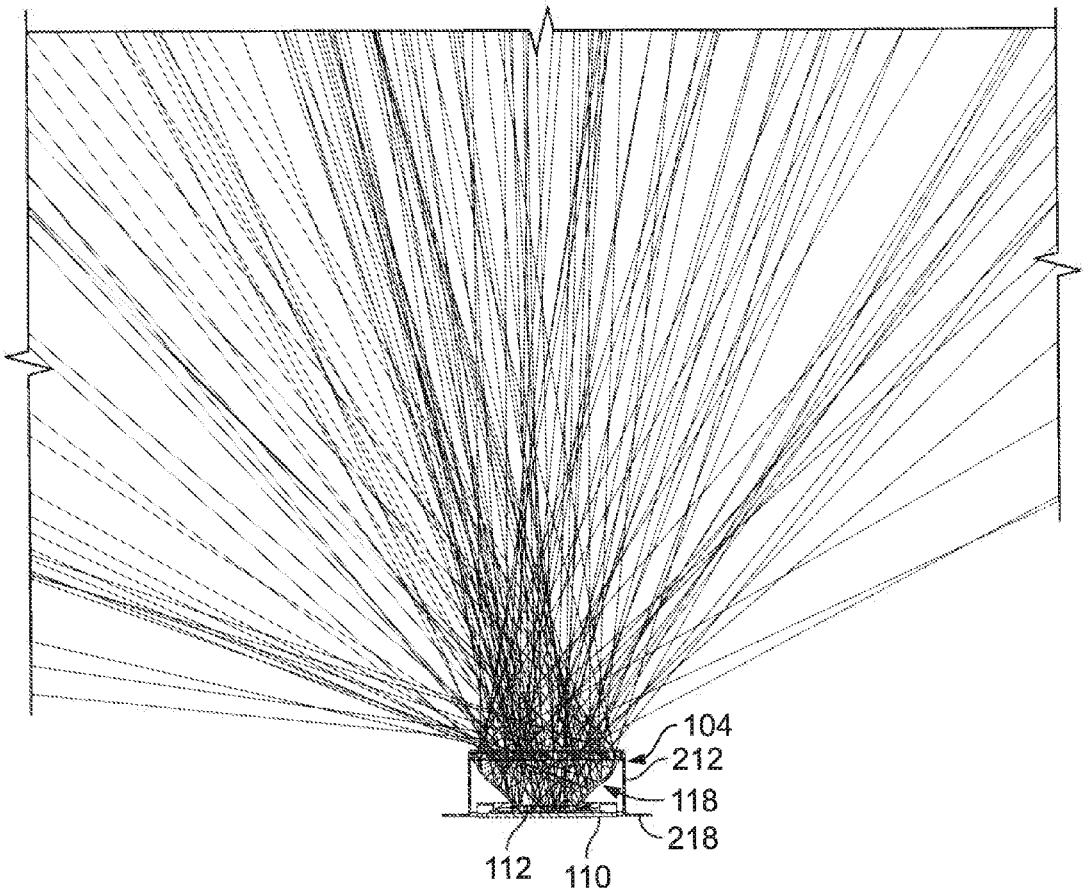
FIG. 23 is a light ray diagram of an array of LEDs.
Figure 26:
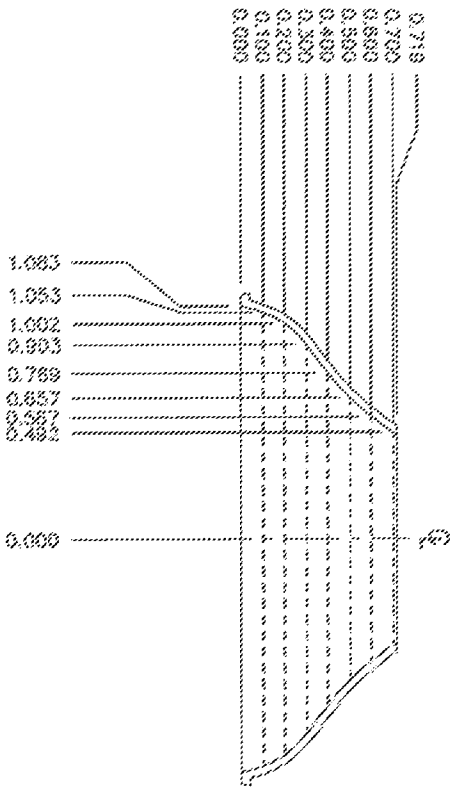
FIG. 26 is a cross sectional view of the reflector illustrating sample dimensions thereof (in inches).

The convex and concave inner reflective surfaces 208, 210 of the reflector 118 direct the rays of light emitted from the LEDs in a crossfire manner throughout the reflector 118 and through the diffuser 120 as shown in FIGS. 21-23. More specifically, the convex inner reflective surface 208 provides crossfire illumination of the light rays and the concave inner reflective surface 210 directs the light rays. The reflector 118 and the diffuser 120 collectively produce a beam spread having a luminaire spacing to mounting height ratio of between about 0.5 and about 1.5 depending on the design of the concave inner reflective surface 210. In the illustrated embodiment, the reflector 118 and the diffuser 120 have a luminaire spacing to mounting height ratio of 1.0. A plurality of lighting devices 100 of the preferred embodiment spaced from adjacent devices at a distance equal to the mounting height of the lighting devices 100 above a planar surface to be illuminated provides a substantially uniform illumination of the planar surface. For example, a plurality of lighting devices spaced eight feet apart in a room with eight-foot ceilings will provide substantially uniform illumination of the floor of the room. FIG. 26 illustrates sample dimensions of the reflector 118, it being understood that the actual dimensions according to the present invention are not limited to same.

It should be noted that the diffuser 120 material and dimensions are selected to scatter light such that the individual LEDs of the LED array 112 appear as a single light source. An example of a suitable material for the diffuser 120 is Solite™, manufactured and sold by AGC Solar of Tokyo, Japan.

Referring to FIGS. 5 and 11, the mounting collar 104 is sized to contain the substrate 110, the centering ring 116, the reflector 118, and the diffuser 120 within a cavity 211. The mounting collar 104 includes a cylindrical main portion 212 extending between a proximal end 214 and a distal end 216. The proximal end 214 includes an outwardly directed flange 218 disposed in abutment with the base plate 148 of the heat exchanger 102. The flange 218 includes a plurality of holes through which fasteners 220 are secured into the plate 148 of the heat exchanger 102. A collar lip 222 extends inwardly at the distal end 216 of the mounting collar 104. When assembled, the substrate 110, the centering ring 116, the reflector 118, and the diffuser 120 are securely held in place within the cavity 211 against the heat exchanger 102 by the collar lip 222 of the mounting collar 104.

In the preferred embodiment, the LED array 112 and the driver circuit 114 mounted on the second side 126 of the substrate 110 are disposed within the flange 218 of the mounting collar 104. The LED array 112 is disposed on the second surface 126 of the substrate 110 within the proximal end 200 of the reflector 118, while the driver circuit 114 is disposed on the second surface 126 of the substrate 110 outside of the proximal end 200 of the reflector 118. In some embodiments, the wires 132 providing AC power to the driver circuit 114 may extend through the holes 180*c*, 128*c* of the base plate 148 and the substrate 110, respectively, into the cavity 211. In other embodiments, the substrate 110 alone or in combination with the mounting collar 104 is directly mounted onto the heat exchanger 102.

Figure 24:
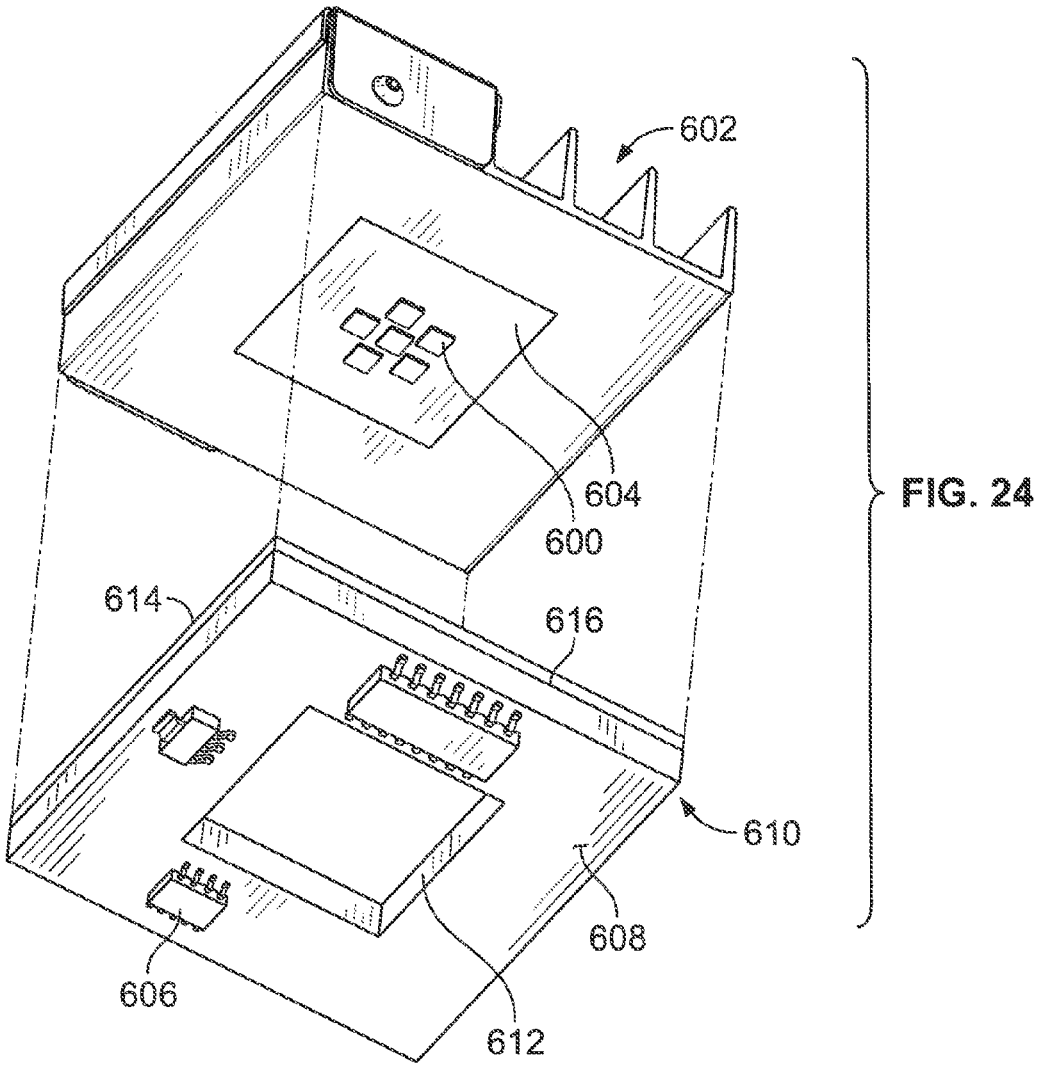
FIG. 24 is an isometric view of a second embodiment of a heat exchanger and driver components.

Alternatively, in an embodiment shown in FIG. 24, a plurality of LEDs 600 is secured by any suitable non-electrically conductive or electrically insulated means (e.g., thermally conductive adhesive and/or fasteners) to the heat exchanger 602 together with any suitable intervening electrically non-conductive structure or material 604 including a thermally conductive submount (e.g., a circuit board) or a film such as Kapton®, manufactured by DuPont of Wilmington, Del. In the illustrated embodiment of FIG. 24, the driver circuitry 606 is mounted on a first side 608 of a square (or other shape) substrate 610 having an inner aperture 612 that is sized to surround the plurality of LEDs 600 when assembled. An electrically insulative and thermally conductive intervening layer or coating 614 is optionally applied to a second side 616 of the substrate 610. The substrate 610 is mounted to the heat exchanger in any suitable fashion including but not limited to the use of fasteners or a thermally conductive adhesive.

Figure 25:
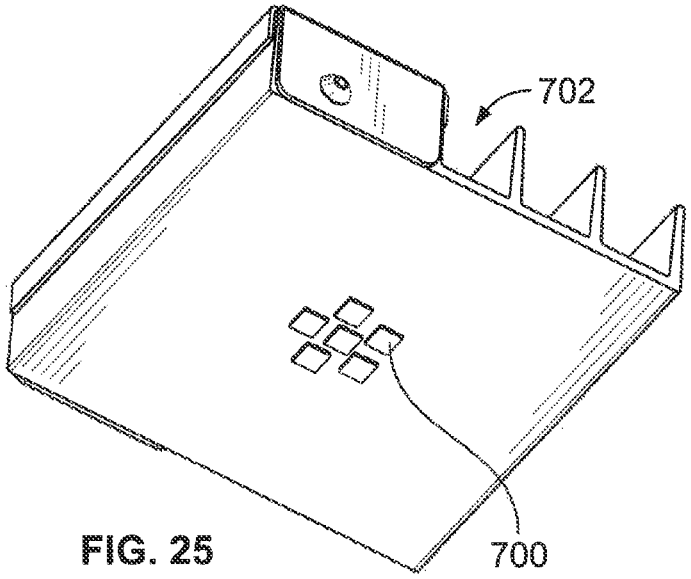
FIG. 25 is an isometric view of a third embodiment of a heat exchanger and driver components.

Further, in an embodiment shown in FIG. 25, a plurality of LEDs 700 is secured directly to the heat exchanger 702 by a thermal cement or other suitable means. In this embodiment, each LED must be designed to have at least one electrode that is not in electrical contact with the material of the heat exchanger, if the heat exchanger is made of electrically conductive material(s). The driver circuitry may be mounted on any suitable structure that is secured (or not secured, if desired) to the heat exchanger.

Referring again to FIGS. 4-7, the housing 108 has a cylindrical housing portion 224 and a frusto-conical cone-shaped housing portion 226. The cylindrical housing portion 224 is dimensioned to fit securely about the cylindrical portion 212 of the mounting collar 104 and is further secured thereto by two diametrically opposed fasteners 225. The cone portion 226 includes an outwardly directed annular flange 228 that receives a shouldered annular surface of the trim ring 106 so that the trim ring 106 sits atop the flange 228. Referring to FIG. 5, the trim ring 106 includes a tapered, annular surface 230 that is visible from the interior of the room. If desired, a different trim ring may be substituted for the illustrated trim ring. In some embodiments, as seen in the FIGS., the trim ring 106 is disposed in thermal communication with the heat exchanger via components including the mounting collar and the housing portion, which may be made of thermally conductive metal(s). In other embodiments, the trim ring may be thermally coupled to the heat exchanger by one or more additional or alternative components. In all these embodiments, the trim ring can dissipate heat. In other embodiments, one or more additional or alternative structures are disposed in thermal communication with the LED array and the heat exchanger is in thermal communication with one or more of the trim ring, the LED array, and/or any other heat transferring and/or dissipating structure(s). Still further in other embodiments, the trim ring, the housing, the mounting collar, and other components may sufficiently dissipate heat such that a heat exchanger is not necessary. In U.S. Pat. No. 7,722,220, the disclosure of which is incorporated by reference herein, the trim ring serves as the thermal conduction element, and heat generated by solid state emitters is conducted through the trim ring and dissipated into the ambient environment of the room.

In one embodiment, the lighting device 100 is equipped with two torsion spring brackets 232, 234 and two torsion springs 236, 238 as shown in FIGS. 1-7 for mounting into a recessed can light housing. Each bracket 232, 234 has a first portion 242 perpendicular to the base plate 148 of the heat exchanger 102, a second portion 244 that extends away from the lighting device 100 at an angle, and a third portion 246. Bracket fasteners 248 (FIGS. 4-6) extend through holes in each of the first portions 242 and the fins 150, 158. Each torsion spring 236, 238 is attached to each third portion 246 by spring fasteners 250. Each torsion spring 236, 238 is made of a flexible spring material to permit elongate legs 236*a*, 236*b*, 238*a*, 238*b* to be compressed toward one another so that hook portions 236*c*, 238*c* can be inserted into slots (not shown) in the can light housing. The legs 236*a*, 236*b*, 238*a*, 238*b* may then be released and the device 100 may be pushed up into the can light housing such that the flange 228 and the trim ring 106 abut the ceiling or other surface and/or a flange (not shown) of the can light housing and the remainder of the lighting device is disposed in the can light housing.

Referring to FIGS. 1-11, sample dimensions of the lighting device 100 are provided in Table 1 below. In the preferred embodiment, the lighting device 100 excluding the wiring 132, 144 preferably has a weight of approximately 368 g. (13 oz.), preferably no greater than about 482 g. (17 oz.), preferably between about 283 g. (10 oz.) and about 455 g. (16 oz.), and more preferably between about 312 g. (11 oz.) and about 425 g. (15 oz.). The lighting device 100 preferably has a weight (as defined above) to lumen ratio of approximately 0.3 g. per lumen (0.01 oz. per lumen), preferably no greater than about 1 g. per lumen (0.035 oz. per lumen), preferably between about 0.14 g. per lumen (0.005 oz. per lumen) and about 0.9 g. per lumen (0.03 oz. per lumen), and more preferably between about 0.2 g. per lumen (0.007 oz. per lumen) and about 0.6 g. per lumen (0.02 oz. per lumen).

TABLE 1

| Sample dimensions of lighting device 100 | |
|---|---|
| A | 102 mm (4 in) |
| B | 76 mm (3 in) |
| C | 102 mm (4 in) |
| D | 89 mm (3.5 in) |
| E | 89.6 mm (3.53 in) |
| F | 17.3 mm (0.68 in) |
| G | 21.6 mm (0.85 in) |
| H | 26.3 mm (1.035 in) |
| I | 62.5 mm (2.46 in) |

In the preferred embodiment, the heat exchanger 102 including the base plate and fins has a size S1 calculated as follows:

$$S1 = \text{length of base plate} * \text{width of base plate} * \text{overall height of the heat exchanger}$$

wherein the overall height of the heat exchanger includes the thickness of the base plate plus the height of the fins. Preferably, S1 is approximately 172 $cm^3$ (11 $in^3$), preferably no greater than about 525 $cm^3$ (32 $in^3$), preferably between about 84 $cm^3$ (5 $in^3$) and about 449 $cm^3$ (27 $in^3$), and more preferably between about 110 $cm^3$ (7 $in^3$) and about 402 $cm^3$ (25 $in^3$). The heat exchanger 102 preferably has a size to lumen ratio of approximately 0.141 $cm^3$ per lumen (0.000840 $in^3$ per lumen), preferably no greater than about 1 $cm^3$ per lumen (0.06 $in^3$ per lumen), preferably between about 0.042 $cm^3$ per lumen (0.003 $in^3$ per lumen) and about 0.9 $cm^3$ per lumen (0.05 $in^3$ per lumen), and more preferably between about 0.06 $cm^3$ per lumen (0.004 $in^3$ per lumen) and 0.5 $cm^3$ per lumen (0.03 $in^3$ per lumen). Additionally, the heat exchanger 102 preferably has a weight of approximately 113 g. (4 oz.), preferably no greater than about 198 g. (7 oz.), preferably between about 85 g. (3 oz.) and about 170 g. (6 oz.), and more preferably between about 99 g. (3.5 oz.) and about 142 g. (5 oz.). The heat exchanger 102 preferably has a weight to lumen ratio of approximately 0.09 g. per lumen (0.003 oz. per lumen), preferably no greater than about 0.4 g. per lumen (0.014 oz. per lumen), preferably between about 0.04 g. per lumen (0.001 oz. per lumen) and about 0.3 g. per lumen (0.01 oz. per lumen), and more preferably between about 0.06 g. per lumen (0.002 oz. per lumen) and about 0.2 g. per lumen (0.007 oz. per lumen).

Further, the light engine 101, the heat exchanger 102, and the mounting collar 104 have a combined size S2 calculated as follows:

$$S2=S1+(\pi*(\text{radius of mounting collar})^2*\text{height of mounting collar})$$

Preferably, S2 is approximately 255 $cm^3$ (16 $in^3$), preferably no greater than about 756 $cm^3$ (46 $in^3$), preferably between about 123 $cm^3$ (8 $in^3$) and about 637 $cm^3$ (39 $in^3$), and more preferably between about 170 $cm^3$ (10 $in^3$) and about 557 $cm^3$ (34 $in^3$). The light engine 101, the heat exchanger 102, and the mounting collar 104 preferably have a size to lumen ratio of approximately 0.2 $cm^3$ per lumen (0.01 $in^3$ per lumen), preferably no greater than about 1.5 $cm^3$ per lumen (0.09 $in^3$ per lumen), preferably between about 0.06 $cm^3$ per lumen (0.004 $in^3$ per lumen) and about 1 $cm^3$ per lumen (0.06 $in^3$ per lumen), and more preferably between about 0.09 $cm^3$ per lumen (0.005 $in^3$ per lumen) and about 0.7 $cm^3$ per lumen (0.04 $in^3$ per lumen).

The lighting device 100 excluding the wiring 144, the trim ring 106, torsion spring brackets 232, 234, and two torsion springs 236, 238 has an overall size S3 calculated as follows:

$$S3=S2+(\pi*\text{height of cone housing portion})/3*((\text{smaller radius of cone housing portion})^2+(\text{smaller radius of cone housing portion})(\text{larger radius of cone housing portion})+(\text{larger radius of cone housing portion})^2)$$

Preferably, S3 is approximately 524 $cm^3$ (32 $in^3$), preferably no greater than about 2,004 $cm^3$ (122 $in^3$), preferably between about 148 $cm^3$ (9 $in^3$) and about 1,530 $cm^3$ (93 $in^3$), and more preferably about 352 $cm^3$ (21 $in^3$) to about 1,157 $cm^3$ (71 $in^3$). The lighting device 100 preferably has a size to lumen ratio of approximately 0.4 $cm^3$ per lumen (0.02 $in^3$ per lumen), preferably no greater than about 4 $cm^3$ per lumen (0.2 $in^3$ per lumen), preferably between about 0.07 $cm^3$ per lumen (0.004 $in^3$ per lumen) and about 3 $cm^3$ per lumen (0.2 $in^3$ per lumen), and more preferably between about 0.2 $cm^3$ per lumen (0.01 $in^3$ per lumen) and about 1.5 $cm^3$ per lumen (0.09 $in^3$ per lumen).

A profile P1 of the lighting device 100 is defined as the diameter C (FIG. 5) of the distal end of the cone portion 226 including the flange 228 times the distance A (FIG. 4) from an outermost edge of the trim ring 106 to the upper surface of the heat exchanger 102 including the splice box cover 164 and the grommet 182, and excluding the wiring 144. Preferably, the lighting device 100 has a profile P1 of approximately 104 $cm^2$ (16 $in^2$), preferably no greater than about 310 $cm^2$ (48 $in^2$), preferably between about 52 $cm^2$ (8 $in^2$) and about 248 $cm^2$ (38 $in^2$), and more preferably between about 97 $cm^2$ (15 $in^2$) and about 194 $cm^2$ (30 $in^2$). Further, the lighting device 100 preferably has a profile P1 to lumen ratio of approximately 0.08 $cm^2$ per lumen (0.01 $in^2$ per lumen), preferably no greater than about 0.6 $cm^2$ per lumen (0.09 $in^2$ per lumen), preferably between about 0.03 $cm^2$ per lumen (0.005 $in^2$ per lumen) and about 0.5 $cm^2$ per lumen (0.08 $in^2$ per lumen), and more preferably between about 0.05 $cm^2$ per lumen (0.008 $in^2$ per lumen) and about 0.3 $cm^2$ per lumen (0.05 $in^2$ per lumen).

Figure 12:
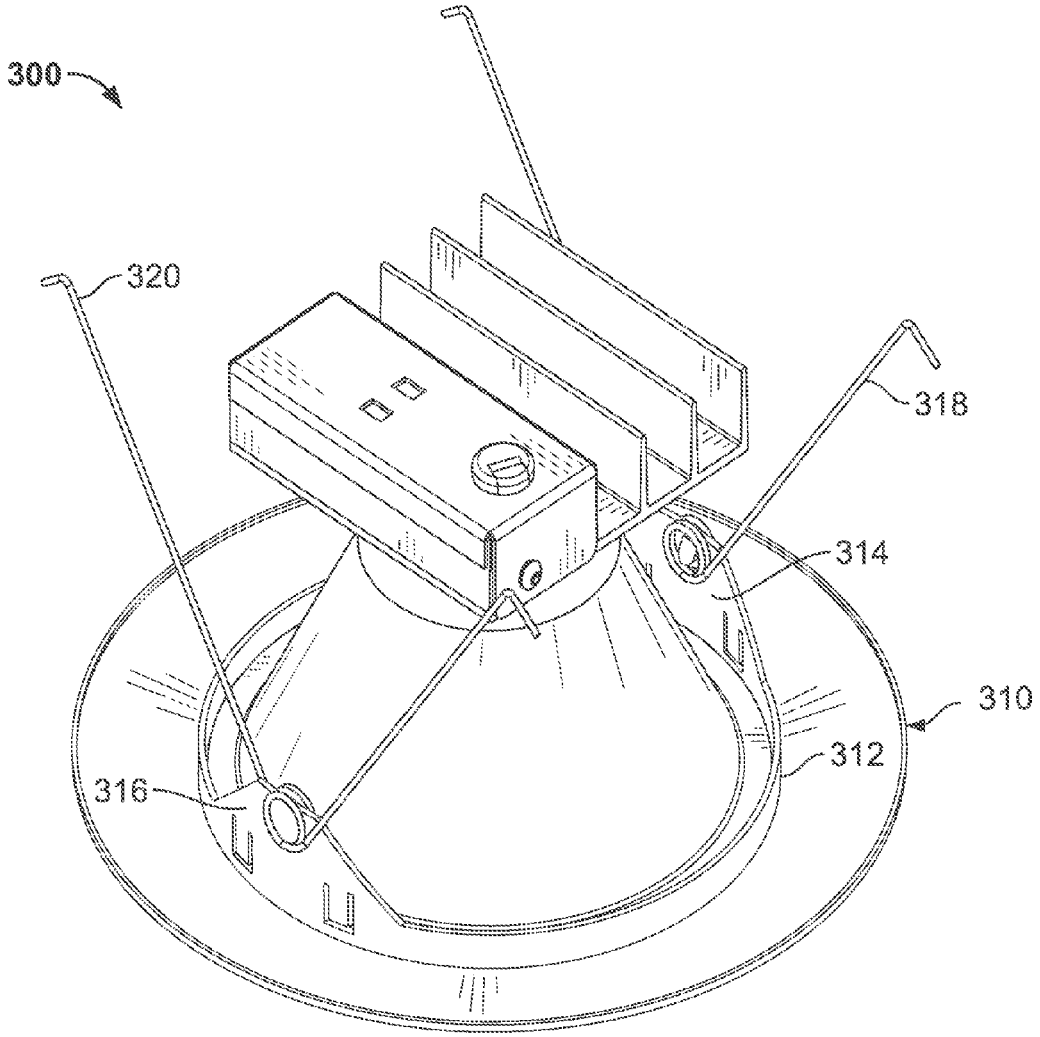
FIG. 12 is an isometric view of a second embodiment of a lighting device from above.
Figure 13:
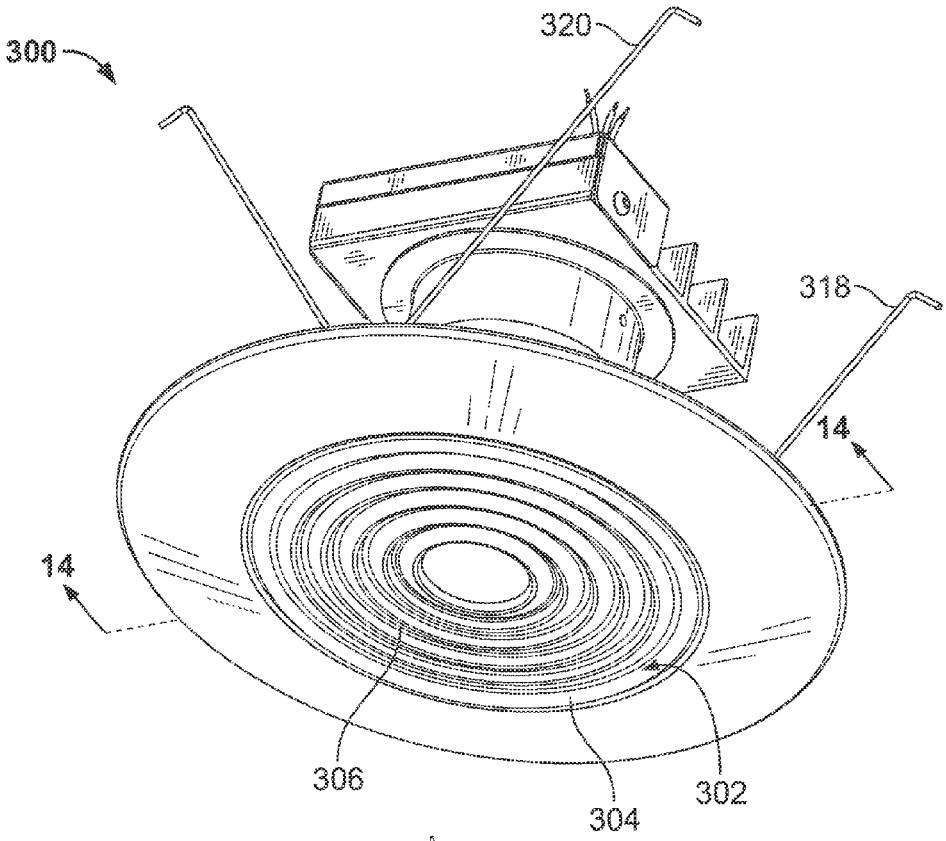
FIG. 13 is an isometric view of the second embodiment of the lighting device from below.
Figure 14:
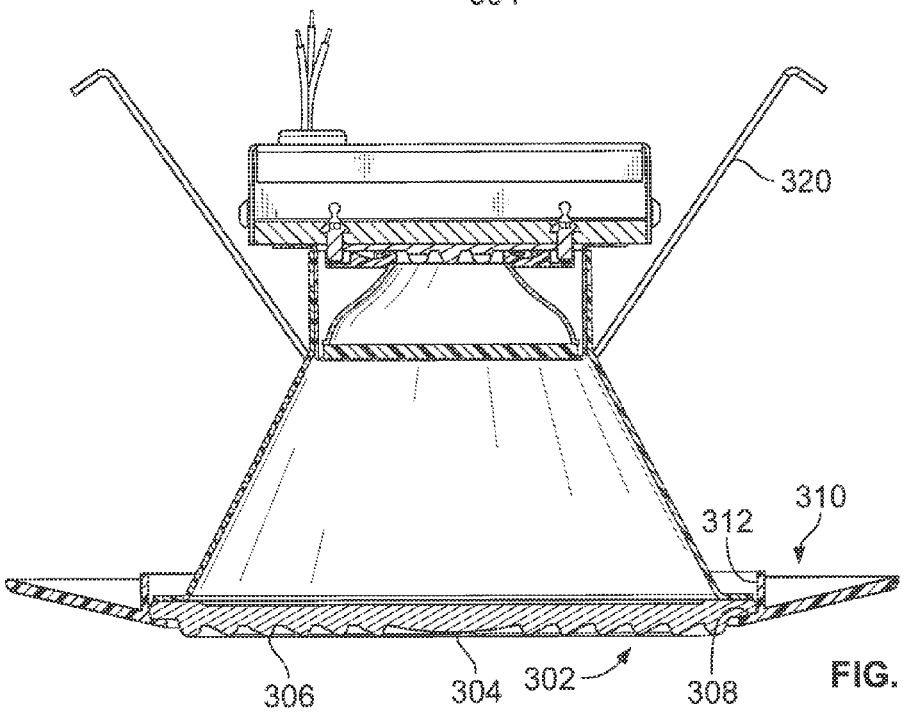
FIG. 14 is a cross sectional view taken generally along the lines 14-14 of FIG. 13.

In an embodiment shown in FIGS. 12-14, the lighting device 300 includes a lens 302 to block the entrance of steam and water into the lighting device 100 when used in a shower or other wet environment. Except for the structures to maintain the lens 302 in place as described below, the lighting device 300 including the parameters is identical to the lighting device 100.

An exposed surface 304 of the lens 302 includes a plurality of concentric, annular ribs 306. The lens 302 rests atop an inner annular ledge 308 of a trim ring 310. The trim ring 310 further includes a cylindrical portion 312 from which two diametrically opposed tabs 314, 316 extend. The tabs 314, 316 are disposed between the windings of two torsion springs 318, 320. The torsion springs 318, 320 are secured to the tabs by any suitable means, such as fasteners (not shown).

The second embodiment of the lighting device 300 excluding the wiring and the lens 302 has a weight of approximately 368 g. (13 oz.), preferably no greater than about 482 g. (17 oz.), preferably between about 283 g. (10 oz.) and about 455 g. (16 oz.), and more preferably between about 312 g. (11 oz.) and about 425 g. (15 oz.). The lighting device 100 preferably has a weight (as defined above) to lumen ratio of approximately 0.3 g. per lumen (0.01 oz. per lumen), preferably no greater than about 1 g. per lumen (0.035 oz. per lumen), preferably between about 0.14 g. per lumen (0.005 oz. per lumen) and about 0.9 g. per lumen (0.03 oz. per lumen), and more preferably between about 0.2 g. per lumen (0.007 oz. per lumen) and about 0.6 g. per lumen (0.02 oz. per lumen).

Figure 15:
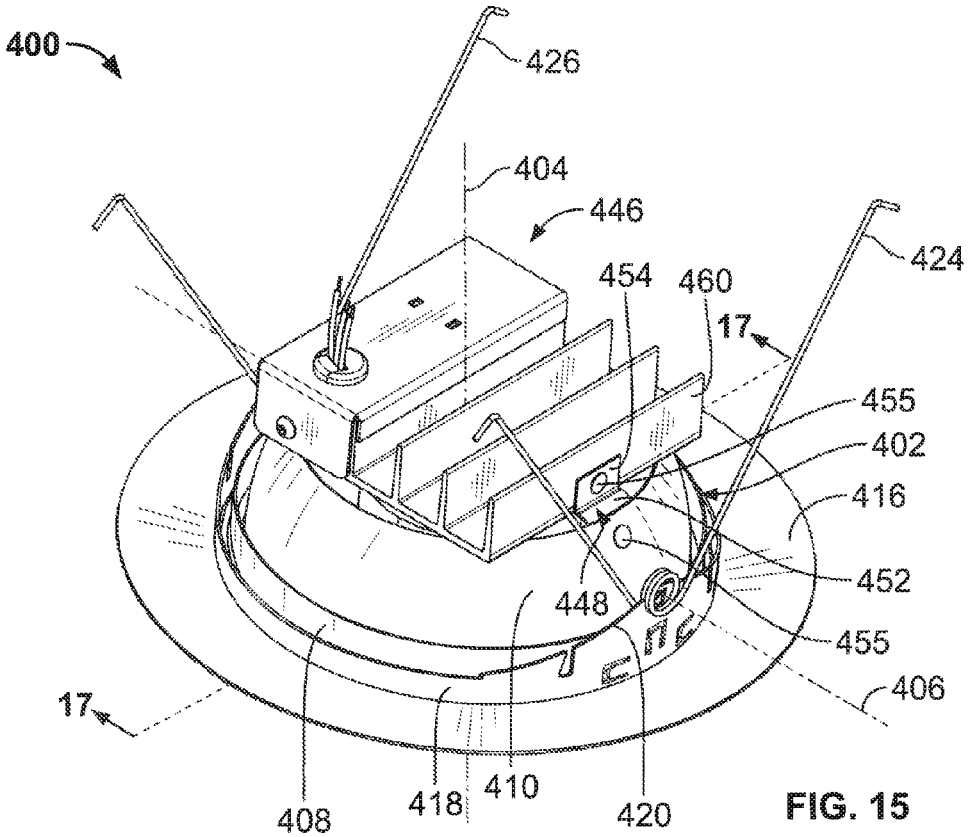
FIG. 15 is an isometric view of the third embodiment of a lighting device from above.
Figure 16:
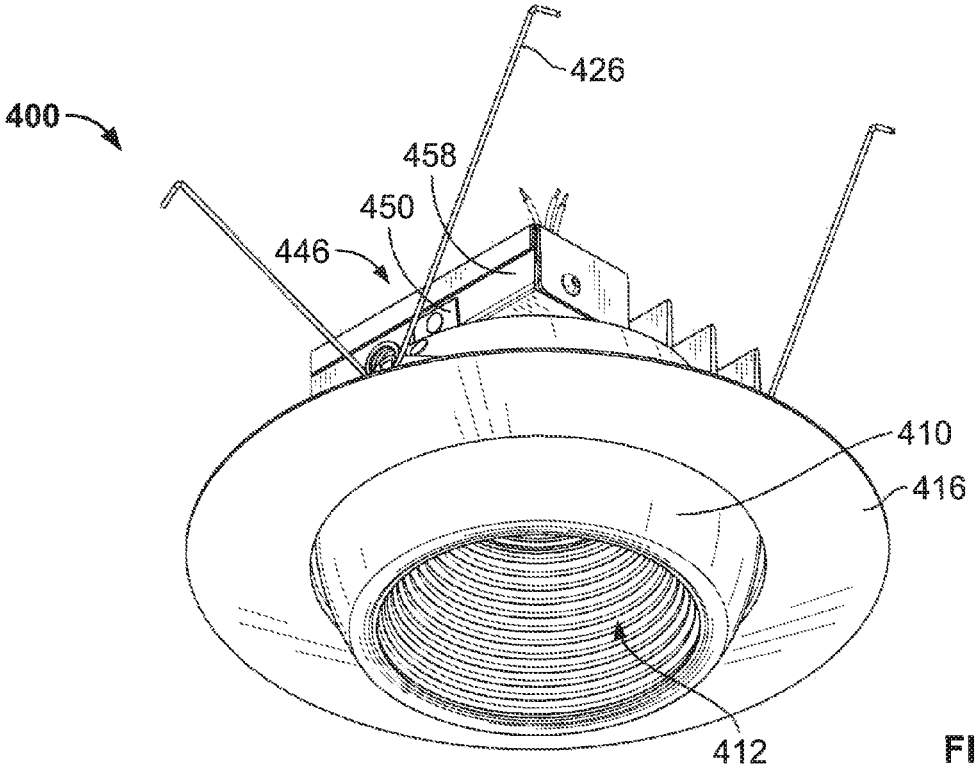
FIG. 16 is an isometric view of the third embodiment of the lighting device from below.
Figure 17:
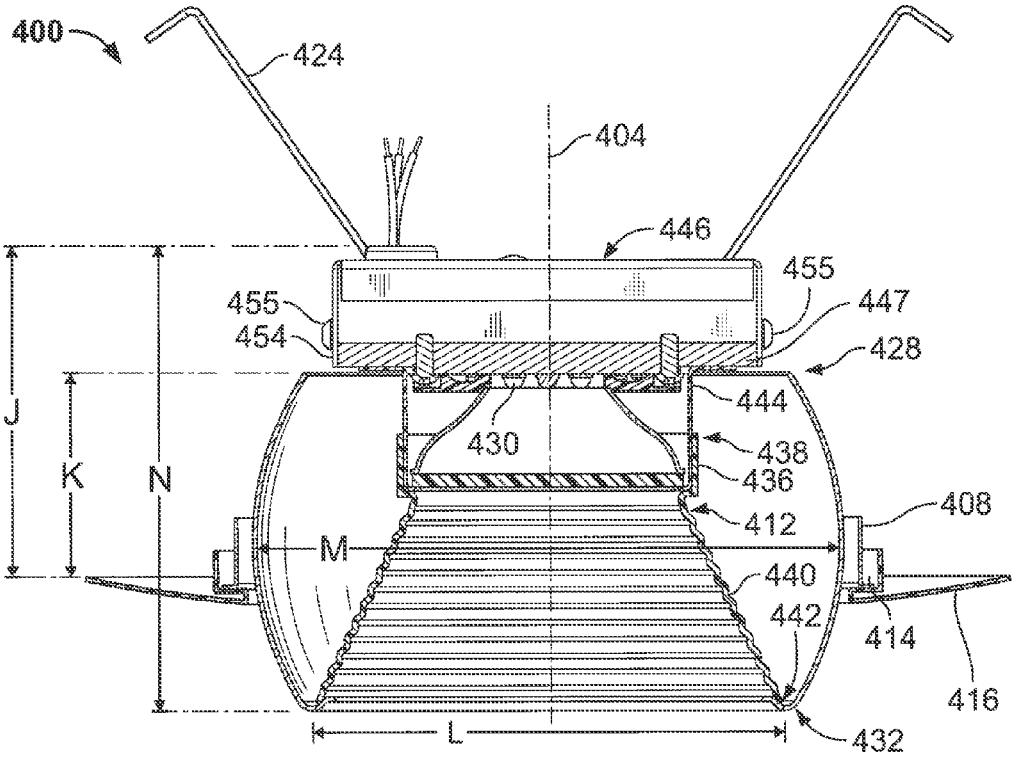
FIG. 17 is a cross sectional view taken generally along the lines 17-17 of FIG. 15.

FIGS. 15-17 illustrate another embodiment of the invention. In this embodiment, the lighting device 400 comprises an eyeball type device that includes a multi-component housing 402 to enable a beam of light to be rotated about a vertical axis of rotation 404 and a horizontal axis of rotation 406. Except for the structures to enable rotation of the beam of light as described below, the lighting device 400 including the parameters is identical to the lighting device 100 of the first embodiment.

The housing 402 includes a housing ring 408, an outer housing 410, and an inner housing 412. The housing ring 408 is cylindrical with a housing ring ledge 414 extending annularly from the bottom thereof that rests atop and is rotatable with respect to a trim ring 416. The trim ring includes a cylindrical portion 418 from which two diametrically opposed tabs 420, 422 extend. The tabs 420, 422 are inserted between the windings of two torsion springs 424, 426. The torsion springs 424, 426 are secured to the tabs 420, 422 by any suitable means, such as fasteners (not shown).

The outer housing 410 has a frusto-spherical shape having a proximal end 428 adjacent an LED array 430 and a distal end 432. The outer housing 414 is rotatable about two diametrically opposed fasteners 434 that are inserted through holes in the housing ring 408 and the outer housing 410. The inner housing 412 includes a cylindrical portion 436 adjacent a proximal end 438 and a corrugated frusto-conical cone-shaped portion 440 adjacent a distal end 442. The cylindrical portion 436 is dimensioned to fit securely about a mounting collar 444.

The housing 402 is secured to a heat exchanger 446 by two brackets 448, 450. A first portion 452 of the each bracket 448, 450 complements the curvature of the outer housing 410 and a second portion 454 extends perpendicular to a base plate 452. Fasteners 455 such as screws are inserted through the outer housing 410 and the first portion 452 of each bracket 448, 450 and through the second portion 454 and fins 458, 460 that extend from a base plate 447 of a heat exchanger 446.

Referring to FIGS. 15-17, sample dimensions of the lighting device 400 are provided in Table 2 below. In the preferred embodiment, the lighting device 400 has a weight (excluding wiring) of approximately 680 g. (24 oz.), and preferably no greater than about 850 g. (30 oz.). Preferably, the lighting device 400 has a weight to lumen ratio of approximately 0.5 g. per lumen (0.02 oz. per lumen), and preferably no greater than about 1.7 g. per lumen (0.06 oz. per lumen).

TABLE 2

| Sample dimensions of lighting device 400 | |
|---|---|
| J | 65 mm (2.6 in) |
| K | 39 mm (1.5 in) |
| L | 100 mm (3.9 in) |
| M | 124 mm (4.9 in) |
| N | 98 mm (3.9 in) |

The lighting device 400 excluding the wiring preferably has an overall size S4 excluding the wiring and the trim ring 416 calculated as follows:

$$S4=S1+(\pi*\text{height of the outer housing})/3*(2*(\text{radius of the largest diameter in the outer housing})^2+(\text{radius of outer housing at the proximal and distal ends})^2)$$

Preferably, S4 is approximately 944 $cm^3$ (58 $in^3$), preferably no greater than about 1,625 $cm^3$ (99 $in^3$), preferably between about 537 $cm^3$ (33 $in^3$) and about 1,372 $cm^3$ (84 $in^3$), and more preferably between about 678 $cm^3$ (41 $in^3$) and about 1,301 $cm^3$ (79 $in^3$). The lighting device 400 excluding the wiring preferably has a size to lumen ratio of approximately 0.8 $cm^3$ per lumen (0.05 $in^3$ per lumen), preferably no greater than about 3.3 $cm^3$ per lumen (0.2 $in^3$ per lumen), preferably between about 0.3 $cm^3$ per lumen (0.02 $in^3$ per lumen) and about 3.0 $cm^3$ per lumen (0.2 $in^3$ per lumen), and more preferably between about 0.4 $cm^3$ per lumen (0.02 $in^3$ per lumen) and about 2 $cm^3$ per lumen (0.1 $in^3$ per lumen).

In this embodiment, the profile P2 is defined as the diameter M (FIG. 17) of the outer housing 410 times the distance N (FIG. 17) from the distal end 432 of the outer housing 410 to a distal surface of the heat exchanger 446 including a splice box cover and a grommet, and excluding the wiring. Preferably, the lighting device 400 has a profile P2 of approximately 122 $cm^2$ (19 $in^2$), preferably no greater than about 177 $cm^2$ (27 $in^2$), preferably between about 87 $cm^2$ (13 $in^2$) and about 161 $cm^2$ (25 $in^2$), and more preferably between about 100 $cm^2$ (16 $in^2$) and about 148 $cm^2$ (23 $in^2$). The lighting device 400 preferably has a profile P2 to lumen ratio of approximately 0.1 $cm^2$ per lumen (0.02 $in^2$ per lumen), preferably no greater than about 0.4 $cm^2$ per lumen (0.06 $in^2$ per lumen), preferably between about 0.04 $cm^2$ per lumen (0.006 $in^2$ per lumen) and about 0.3 $cm^2$ per lumen (0.05 $in^2$ per lumen), and more preferably between about 0.06 $cm^2$ per lumen (0.009 $in^2$ per lumen) and about 0.2 $cm^2$ per lumen (0.03 $in^2$ per lumen).

Figure 18:
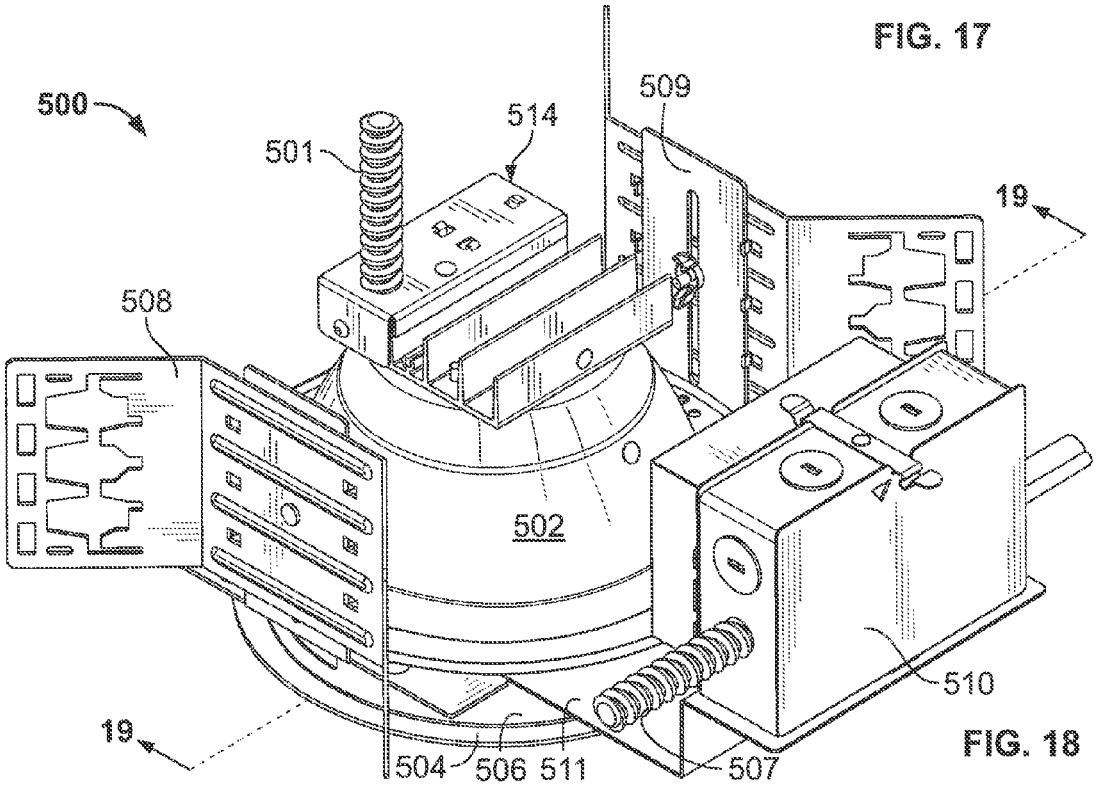
FIG. 18 is an isometric view of a fourth embodiment of a lighting device from above.
Figure 19:
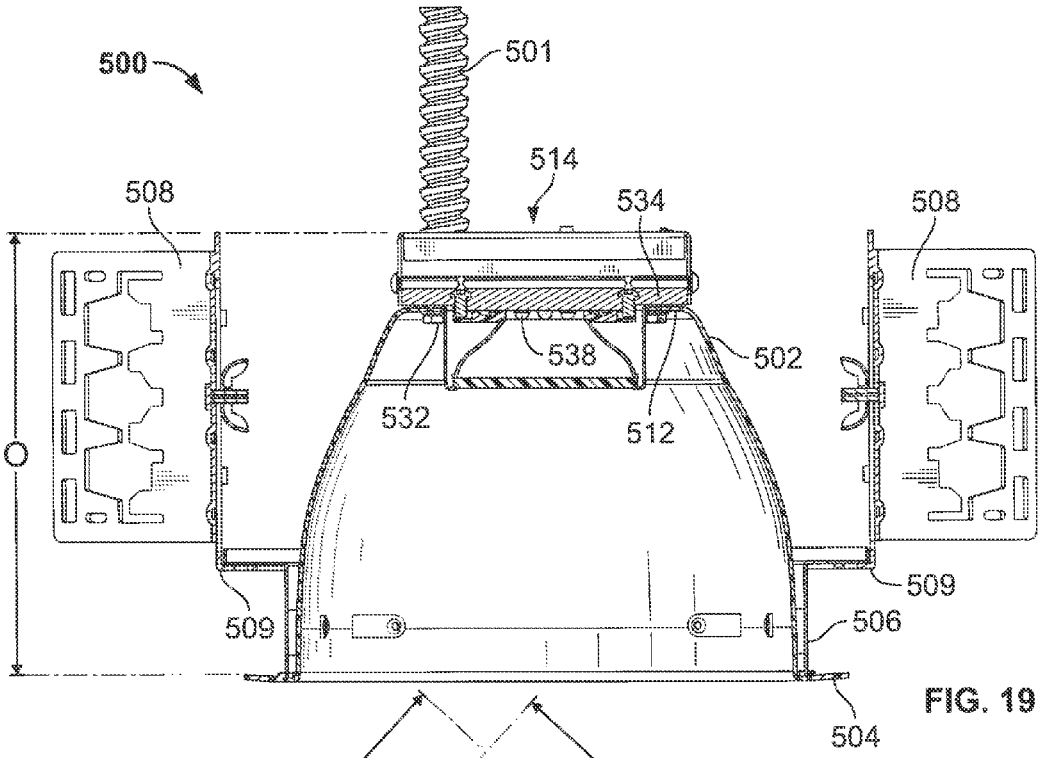
FIG. 19 is a cross sectional view taken generally along the lines 19-19 of FIG. 18.
Figure 20:
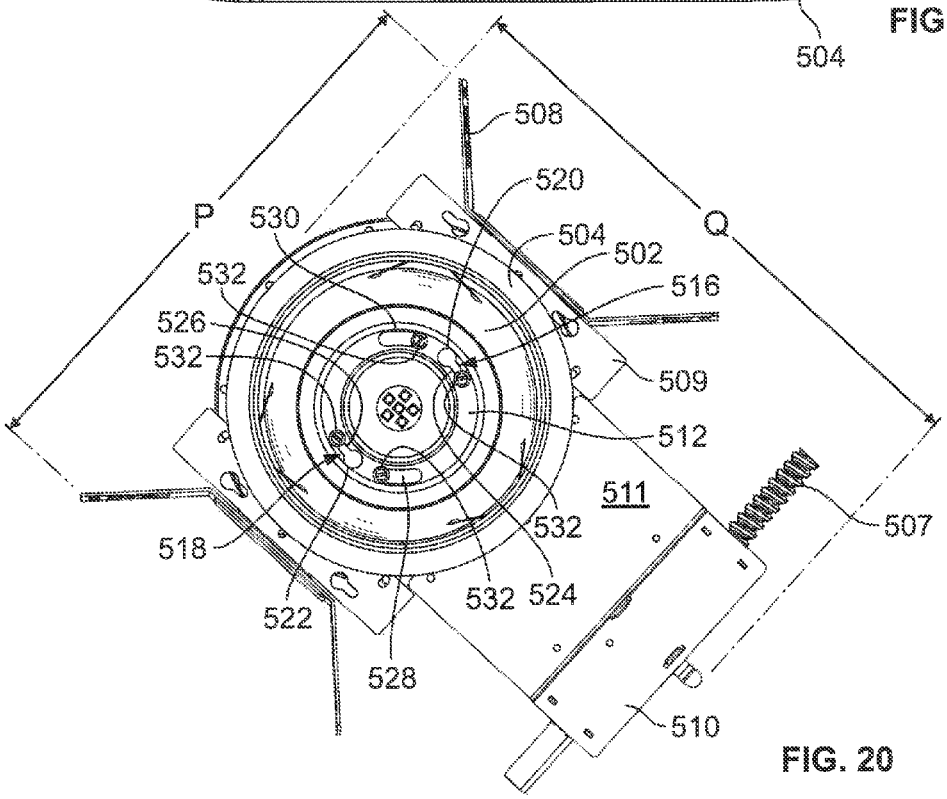
FIG. 20 is a plan view of the fourth embodiment of the lighting device from below.

In a fourth embodiment shown in FIGS. 18-20, the lighting device 500 is designed for new construction or remodeling. The lighting device 500 includes a housing 502, a trim ring 504 having a trim ring frame 506, a mounting system 508, and a junction box 510. Except for the structures to enable use of the lighting device 500 for new construction as described below, the lighting device 500 including the parameters is identical to the lighting device 100 of the first embodiment.

Seen in FIGS. 19 and 20, the housing 502 includes an inwardly extending housing flange 512 adjacent a heat exchanger 514. Two keyed openings 516, 518 having wide ends 520, 522 and narrow ends 524, 526 and two oblong openings 528, 530 are formed in the housing flange 512. Four fasteners 532 are inserted partially into a base plate 534 of the heat exchanger 514. To secure the housing 502 to the heat exchanger 514, the housing 502 is placed on the heat exchanger 514 such that heads of the fasteners 536 are positioned in the two wide ends 520, 522 of keyed openings 516, 518 and the two oblong openings 528, 530 and the housing 502 is rotated relative to the heat exchanger 514 to cause shanks of the fasteners 532 to move into the narrow ends 524, 526 of the keyed openings 516, 518 and the two oblong openings 528, 530. The fasteners 532 can then be tightened down to maintain the parts in assembled relationship.

The trim ring frame 506 to which the mounting system 508 is attached rests atop the trim ring 504. The mounting system 508 may be used to mount the lighting device 500 into a joist space or other cavity. Wires 507 from junction box 510 provide power to an LED array 538 of the lighting device 500. A thermal protection device housed in a splice box of the heat exchanger 514 may disconnect power to a driver circuit and an LED array in the event of an overtemperature condition.

Referring to FIGS. 18-20, sample dimensions of the lighting device 500 are provided in Table 3 below. In the preferred embodiment, the lighting device 500 excluding wiring 501, the junction box 510 and associated conduit 507 and mounting structure 511, and two C-shaped brackets 508 and mounting bracket system 509 of mounting system 508 has a weight of approximately 1,247 g. (44 oz.). The lighting device 500 preferably has a weight (as defined above) to lumen ratio of approximately 1 g. per lumen (0.04 oz. per lumen), preferably no greater than about 2.5 g. per lumen (0.09 oz. per lumen), preferably between about 0.6 g. per lumen (0.02 oz. per lumen) and about 2.5 g. per lumen (0.09 oz. per lumen), and more preferably between 0.7 g. per lumen (0.02 oz. per lumen) and about 2.5 g. per lumen (0.09 oz. per lumen).

TABLE 3

| Sample dimensions of lighting device 500 | |
|---|---|
| O | 137 mm (5.4 in) |
| P | 305 mm (12 in) |
| Q | 305 mm (12 in) |

The lighting device 500 excluding the wiring 501, the junction box 510 and associated conduit 507 and mounting structure 511, and two C-shaped brackets 508 and mounting bracket system 509 of mounting system 508 preferably has an overall size S5 of approximately 1,639 $cm^3$ (100 $in^3$), preferably no greater than about 2,458 $cm^3$ (150 $in^3$), preferably between about 1,229 $cm^3$ (75 $in^3$) and about 2,294 $cm^3$ (140 $in^3$), and more preferably between about 1,393 $cm^3$ (85 $in^3$) and about 2,130 $cm^3$ (130 $in^3$). The lighting device 500 excluding the wiring 501, the junction box 510 and associated conduit 507 and mounting structure 511, and two C-shaped brackets 508 and mounting bracket system 509 of mounting system 508 preferably has a size to lumen ratio of approximately 1.3 $cm^3$ per lumen (0.08 $in^3$ per lumen), no greater than about 5 $cm^3$ per lumen (0.3 $in^3$ per lumen), preferably between about 0.6 $cm^3$ per lumen (0.04 $in^3$ per lumen) and about 4.6 $cm^3$ per lumen (0.3 $in^3$ per lumen), and more preferably between about 0.7 $cm^3$ per lumen (0.04 $in^3$ per lumen) and about 2.8 $cm^3$ per lumen (0.2 $in^3$ per lumen).

In this embodiment, the profile P3 is defined as the distance Q (FIG. 20) from an outer surface of the junction box 510 to an opposite edge of the trim ring 504 times the distance O (FIG. 19) from an outermost edge of the trim ring 504 to an outer surface of the heat exchanger 514. In some embodiments, the lighting device 500 preferably has a profile P3 of approximately 418 $cm^2$ (65 $in^2$), preferably no greater than about 619 $cm^2$ (96 $in^2$), preferably between about 258 $cm^2$ (40 $in^2$) and about 581 $cm^2$ (90 $in^2$), and more preferably between about 290 $cm^2$ (45 $in^2$) and about 542 $cm^2$ (84 $in^2$). Further, the lighting device 500 has a profile P3 to lumen ratio of approximately 0.3 $cm^2$ per lumen (0.05 $in^2$ per lumen), no greater than about 1.2 $cm^2$ per lumen (0.2 $in^2$ per lumen), preferably between about 0.1 $cm^2$ per lumen (0.02 $in^2$ per lumen) and about 1.2 $cm^2$ per lumen (0.2 $in^2$ per lumen), and more preferably between about 0.2 $cm^2$ per lumen (0.03 $in^2$ per lumen) and about 0.7 $cm^2$ per lumen (0.1 $in^2$ per lumen).

Other embodiments of the disclosure including all of the possible different and various combinations of the individual features of each of the foregoing embodiments and examples are specifically included herein.

Industrial Applicability

The lighting devices described herein advantageously include a reflector having a reflection surface that is convex on a first side of an inflection locus and concave on a second side of the inflection locus that provides a beam spread having a luminaire spacing to mounting height ratio of preferably between about 0.5 and about 1.5. Further, particular embodiments of the lighting devices disclosed herein advantageously utilize a compact heat exchanger in thermal communication with an LED array and, optionally, a driver circuit so that overall device size, weight, and profile are reduced and efficacy is maintained above 50 lumens per watt.

Numerous modifications to the present disclosure will be apparent to those skilled in the art in view of the foregoing description. Accordingly, this description is to be construed as illustrative only and is presented for the purposes of enabling those skilled in the art to make and use the present disclosure and to teach the best mode of carrying out the same.

We claim:

1. A lighting device, comprising:

a light emitting diode (LED);

a heat exchanger with which the LED is disposed in heat transfer relationship;

a reflector having a proximal end disposed about the LED;

a driver circuit disposed on a substrate for operating the LED wherein the driver circuit is adapted to be directly connected to an alternating current (AC) power source;

a diffuser disposed on a distal end of the reflector; and a mounting collar for maintaining the heat exchanger, the LED, the reflector, and the diffuser in assembled relationship;

wherein a profile to lumen ratio of the entire lighting device is one of no greater than about 1.2 $cm^2$ per lumen (0.2 $in^2$ per lumen), between about 0.03 $cm^2$ per lumen (0.005 $in^2$ per lumen) and about 1.2 $cm^2$ per lumen (0.2 $in^2$ per lumen), and between about 0.05 $cm^2$ per lumen (0.008 $in^2$ per lumen) and about 0.7 $cm^2$ per lumen (0.1 $in^2$ per lumen), and wherein the lighting device has a weight to lumen ratio of no greater than about 2.5 g per lumen (0.09 oz per lumen).

2. The lighting device of claim 1, wherein the weight to lumen ratio is one of between about 0.14 g per lumen (0.005 oz per lumen) and about 2.5 g per lumen (0.09 oz per lumen), and between about 0.5 g per lumen (0.02 oz per lumen) and about 1.7 g per lumen (0.06 oz per lumen).

3. The lighting device of claim 1, wherein a size to lumen ratio of the device is one of no greater than about 5 $cm^3$ per lumen (0.3 $in^3$ per lumen), between about 0.07 $cm^3$ per lumen (0.004 $in^3$ per lumen) and about 4.6 $cm^3$ per lumen (0.3 $in^3$ per lumen), and between about 0.2 $cm^3$ per lumen (0.01 $in^3$ per lumen) and about 2.8 $cm^3$ per lumen (0.2 $in^3$ per lumen).

4. The lighting device of claim 1, wherein a size of the heat exchanger to lumen ratio is one of no greater than about 1 $cm^3$ per lumen (0.06 $in^3$ per lumen), preferably between about 0.042 $cm^3$ per lumen (0.003 $in^3$ per lumen) and about 0.9 $cm^3$ per lumen (0.05 $in^3$ per lumen), and more preferably between about 0.06 $cm^3$ per lumen (0.004 $in^3$ per lumen) and 0.5 $cm^3$ per lumen (0.03 $in^3$ per lumen).

5. The lighting device of claim 1, wherein a weight of the heat exchanger to lumen ratio is one of no greater than about 0.4 g per lumen (0.014 oz per lumen), preferably between about 0.04 g per lumen (0.001 oz per lumen) and about 0.3 g per lumen (0.01 oz per lumen), and more preferably between about 0.06 g per lumen (0.002 oz per lumen) and about 0.2 g per lumen (0.007 oz per lumen).

6. The lighting device of claim 1, wherein a profile of the lighting device is one of no greater than about 619 $cm^2$ (96 $in^2$), between about 52 $cm^2$ (8 $in^2$) and about 581 $cm^2$ (90 $in^2$), and between about 97 $cm^2$ (15 $in^2$) and about 542 $cm^2$ (84 $in^2$).

7. The lighting device of claim 1, wherein the LED is directly mounted on the heat exchanger.

8. The lighting device of claim 1, further including a housing and a trim ring.

9. The lighting device of claim 8, wherein the housing and the trim ring are in heat transfer relationship with the heat exchanger.

10. The lighting device of claim 8, wherein the housing includes an aperture, and the lighting device further comprises a lens displaced about the aperture.

11. A lighting device, comprising:

a substrate including a first surface on which is disposed an LED;

a heat exchanger mounted directly to a second surface of the substrate opposite the first surface;

a reflector having a proximal end disposed about the LED array;

a driver circuit disposed on the substrate for operating the LED wherein the driver circuit is adapted to be directly connected to an AC power source;

a diffuser disposed on a distal end of the reflector; and a mounting collar for maintaining the heat exchanger, the LED, the reflector, and the diffuser in assembled relationship;

wherein a profile to lumen ratio of the entire lighting device is no greater than about 1.2 $cm^2$ per lumen (0.2 $in^2$ per lumen).

12. The lighting device of claim 11, wherein the profile to lumen ratio is one of between about 0.03 $cm^2$ per lumen (0.005 $in^2$ per lumen) and about 1.2 $cm^2$ per lumen (0.2 $in^2$ per lumen), and between about 0.05 $cm^2$ per lumen (0.008 $in^2$ per lumen) and about 0.7 $cm^2$ per lumen (0.1 $in^2$ per lumen).

13. The lighting device of claim 11, wherein a size to lumen ratio of the lighting device is one of no greater than about 5 $cm^3$ per lumen (0.3 $in^3$ per lumen), between about 0.07 $cm^3$ per lumen (0.004 $in^3$ per lumen) and about 4.6 $cm^3$ per lumen (0.3 $in^3$ per lumen), and between about 0.2 $cm^3$ per lumen (0.01 $in^3$ per lumen) and about 2.8 $cm^3$ per lumen (0.2 $in^3$ per lumen).

14. The lighting device of claim 11, wherein a weight of the lighting device to lumen ratio is one of no greater than about 2.5 g per lumen (0.09 oz per lumen), between about 0.14 g per lumen (0.005 oz per lumen) and about 2.5 g per lumen (0.09 oz per lumen), and between about 0.5 g per lumen (0.02 oz per lumen) and about 1.7 g per lumen (0.06 oz per lumen).

15. The lighting device of claim 11, wherein the driver circuit is disposed on the first surface of the substrate.

16. The lighting device of claim 11, further including a housing and a trim ring.

17. The lighting device of claim 16, wherein the housing and the trim ring are in heat transfer relationship with the heat exchanger.

18. The lighting device of claim 16, wherein the housing includes an aperture, and the lighting device further comprises a lens displaced about the aperture.

19. A lighting device, comprising:

a substrate;

an LED array mounted on a first surface of the substrate;

circuit components mounted on the first surface of the substrate and coupled to the LED array wherein the circuit components are adapted to control electrical power applied to the LED array;

a heat exchanger mounted on a second surface of the substrate;

a reflector disposed about the LED array, wherein the reflector has a reflection surface that is convex on a first side of an inflection locus and concave on a second side of the inflection locus, and wherein the first side of the inflection locus is proximate the LED array; and a diffuser adjacent to the second side of the inflection locus of the reflector;

wherein the lighting device has a weight to lumen ratio that is one of no greater than 2.5 g per lumen (0.09 oz per lumen), between about 0.14 g per lumen (0.005 oz per lumen) and about 2.5 g per lumen (0.09 oz per lumen), and between about 0.5 g per lumen (0.02 oz per lumen) and about 1.7 g per lumen (0.06 oz per lumen).

20. The lighting device of claim 19, wherein the circuit components are directly coupled to an AC power source.

21. The lighting device of claim 19, wherein the lighting device has a weight that is one of no greater than about 1,247 g (44 oz), between about 283 g (10 oz) and about 850 g (30 oz), and between about 312 g (11 oz) and about 482 g (17 oz).

22. The lighting device of claim 19, wherein the lighting device has a total lumen output of at least about 50 lumens per watt.

23. The lighting device of claim 19, wherein the heat exchanger can dissipate up to about 6.75 watts of heat.

24. The lighting device of claim 19, wherein the substrate maintains a maximum junction temperature of about 85 degrees Celsius.

25. The lighting device of claim 19, further comprising at least one other lighting device, wherein each lighting device has a luminaire spacing to mounting height ratio of between about 0.5 and about 1.5.

26. The lighting device of claim 19, wherein the heat exchanger comprises a plate, a plurality of fins extending from the plate, and a splice box.

27. The lighting device of claim 19, further comprising an Edison-type plug and a wiring harness coupled to the circuit components and wherein the lighting device is adapted to be inserted into an existing recessed can light in a ceiling such that the Edison type plug may be inserted into an Edison-type socket in the can light.

28. The lighting device of claim 27, wherein the lighting device is mounted in one of a wall or a ceiling and wherein a distal surface of the heat exchanger is up to about 102 mm (4 in) away from a proximal surface of the wall or the ceiling.

29. The lighting device of claim 27, wherein the lighting device produces a beam that can be rotated about a vertical axis and a horizontal axis, and wherein a distal surface of the heat exchanger is up to about 65 mm (2.6 in) away from a proximal surface of the wall or the ceiling.

30. The lighting device of claim 19, wherein the lighting device is used for new construction, wherein the lighting device is mounted in one of a wall or a ceiling, and wherein a distal surface of the heat exchanger is up to about 137 mm (5.4 in) away from a proximal surface of the wall or the ceiling.

31. The lighting device of claim 19, further comprising a centering ring disposed about the LED array adjacent to the substrate; and a mounting collar having a mounting flange for maintaining the heat exchanger, the LED array, the reflector, and the diffuser in assembled relationship;

wherein the mounting flange is secured to the heat exchanger by means of fasteners.

32. The lighting device of claim 31, wherein the heat exchanger and the mounting collar have a size that is one of no greater than about 756 $cm^3$ (46 $in^3$), preferably between about 123 $cm^3$ (8 $in^3$) and about 637 $cm^3$ (39 $in^3$), and more preferably between about 170 $cm^3$ (10 $in^3$) and about 557 $cm^3$ (34 $in^3$).

33. A lighting device, comprising:

a substrate having a surface;

an LED array mounted on the surface of the substrate;

circuit components mounted on the surface of the substrate, coupled to the LED array, and adapted to receive power from a power source;

a reflector disposed about the LED array adjacent a proximal end;

a diffuser adjacent to a distal end of the reflector;

a centering ring disposed about the LED array adjacent to the substrate;

a mounting collar having a mounting flange for maintaining the heat exchanger, the LED array, the reflector, and the diffuser in assembled relationship; and wherein the reflector is disposed within the centering ring, and wherein the lighting device has a weight to lumen ratio of no greater than about 2.5 g per lumen (0.09 oz per lumen).

34. The lighting device of claim 33, wherein the weight to lumen ratio is one of between about 0.14 g per lumen (0.005 oz. per lumen) and about 2.5 g per lumen (0.09 oz per lumen), and between about 0.5 g per lumen (0.02 oz per lumen) and about 1.7 g per lumen (0.06 oz per lumen).

35. The lighting device of claim 33, wherein the circuit components are coupled to an AC voltage source.

36. The lighting device of claim 33, further comprising a housing having a first end and a second end; and a trim ring displaced about the second end;

wherein the mounting flange is secured to the heat exchanger by means of fasteners; and wherein heat is dissipated through the substrate, the mounting collar, the housing, and the trim ring.

37. The lighting device of claim 33, wherein the lighting device can dissipate up to about 6.75 watts of heat.

38. The lighting device of claim 33, wherein the substrate maintains a maximum junction temperature of approximately 85 degrees Celsius.

39. The lighting device of claim 33, further comprising an Edison-type plug and a wiring harness coupled to the circuit components and wherein the lighting device is adapted to be inserted into an existing recessed can light in a ceiling such that the Edison type plug may be inserted into an Edison-type socket in the can light.

40. The lighting device of claim 39, wherein the lighting device is mounted in one of a wall or a ceiling and wherein a distal surface of the heat exchanger is up to about 102 mm (4 in) away from a proximal surface of the wall or the ceiling.

41. The lighting device of claim 39, wherein the lighting device produces a beam that can be rotated about a vertical axis and a horizontal axis, and wherein a top surface of the heat exchanger is up to about 65 mm (2.6 in) away from a proximal surface of the wall or the ceiling.

42. The lighting device of claim 33, wherein the lighting device is used for new construction, wherein the lighting device is mounted in one of a wall or a ceiling, and wherein a top surface of the heat exchanger is up to about 137 mm (5.4 in) away from a proximal surface of the wall or the ceiling.

* * * * *